US011112706B2

(12) United States Patent
Takeuchi et al.

(10) Patent No.: US 11,112,706 B2
(45) Date of Patent: Sep. 7, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Eileen Takeuchi, Tokyo (JP); Kumiko Takizawa, Saitama (JP); Ikuyo Kuroiwa, Tokyo (JP); Tsuyoshi Shimada, Kashiwa (JP); Wataru Kitamura, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/832,508

(22) Filed: Mar. 27, 2020

(65) Prior Publication Data

US 2020/0225595 A1 Jul. 16, 2020

Related U.S. Application Data

(63) Continuation of application No. PCT/JP2018/036856, filed on Oct. 2, 2018.

(30) Foreign Application Priority Data

Oct. 3, 2017 (JP) ..... JP2017-193654

(51) Int. Cl.
*G03G 9/00* (2006.01)
*G03G 5/14* (2006.01)
(Continued)

(52) U.S. Cl.
CPC ..... *G03G 5/144* (2013.01); *G03G 5/047* (2013.01); *G03G 21/18* (2013.01)

(58) Field of Classification Search
CPC ..... G03G 5/144
(Continued)

(56) References Cited

U.S. PATENT DOCUMENTS 5,198,685 A 3/1993 Kitani et al.
5,876,890 A 3/1999 Kitamura et al.
(Continued)

FOREIGN PATENT DOCUMENTS

JP H08-22136 1/1996
JP H10-301314 11/1998
(Continued)

OTHER PUBLICATIONS

U.S. Appl. No. 16/731,150, Eileen Takeuchi, filed Dec. 31, 2019.
U.S. Appl. No. 16/894,988, Eileen Takeuchi, filed Jun. 8, 2020.

*Primary Examiner* — Mark A Chapman
(74) *Attorney, Agent, or Firm* — Venable LLP

(57) ABSTRACT

Provided is an electrophotographic photosensitive member in which the generation of a positive ghost image is suppressed under a low-temperature and low-humidity environment, and the occurrence of cracking is suppressed under a high-temperature and high-humidity environment. Also provided are a process cartridge mounted with the electrophotographic photosensitive member, and an electrophotographic apparatus including the process cartridge. The electrophotographic photosensitive member of the present disclosure is characterized in that an undercoat layer contains aluminum oxide particles and titanium oxide particles at a specific mass ratio.

20 Claims, 5 Drawing Sheets

(51) Int. Cl.
*G03G 5/047* (2006.01)
*G03G 21/18* (2006.01)

(58) Field of Classification Search
USPC ..... 430/63, 65
See application file for complete search history.

(56) References Cited

U.S. PATENT DOCUMENTS

| | | | | |
|---|---|---|---|---|
| 5,912,098 | A | 6/1999 | Tanaka et al. | |
| 6,355,390 | B1 * | 3/2002 | Yamanami | G03G 5/142 399/130 |
| 6,405,005 | B1 | 6/2002 | Kitamura et al. | |
| 6,408,152 | B1 | 6/2002 | Kitamura et al. | |
| 7,645,547 | B2 | 1/2010 | Okuda et al. | |
| 7,655,370 | B2 | 2/2010 | Kitamura et al. | |
| 7,813,675 | B2 | 10/2010 | Tanabe et al. | |
| 8,932,787 | B2 | 1/2015 | Kurimoto et al. | |
| 9,494,880 | B2 | 11/2016 | Noguchi et al. | |
| 9,588,448 | B2 | 3/2017 | Sugiyama et al. | |
| 9,766,561 | B2 | 9/2017 | Takahashi et al. | |
| 9,778,582 | B2 | 10/2017 | Kitamura et al. | |
| 9,791,792 | B2 | 10/2017 | Miyauchi et al. | |
| 9,811,012 | B2 | 11/2017 | Murakami et al. | |
| 9,817,324 | B2 | 11/2017 | Kitamura et al. | |
| 9,971,258 | B2 | 5/2018 | Kitamura et al. | |
| 9,983,490 | B2 | 5/2018 | Shimada et al. | |
| 10,042,273 | B2 | 8/2018 | Takahashi et al. | |
| 10,241,429 | B2 | 3/2019 | Shimada et al. | |
| 10,353,340 | B2 | 7/2019 | Kuroiwa et al. | |
| 10,488,770 | B2 | 11/2019 | Kuroiwa et al. | |
| 2014/0004450 | A1 | 1/2014 | Tokimitsu et al. | |
| 2018/0314188 | A1 | 11/2018 | Takeuchi et al. | |
| 2019/0369513 | A1 | 12/2019 | Ueno et al. | |
| 2020/0133146 | A1 | 4/2020 | Shimada et al. | |
| 2020/0133147 | A1 | 4/2020 | Takizawa et al. | |
| 2020/0133148 | A1 | 4/2020 | Ikezue et al. | |
| 2020/0133149 | A1 | 4/2020 | Ueno et al. | |
| 2020/0159136 | A1 | 5/2020 | Mori et al. | |

FOREIGN PATENT DOCUMENTS

| | | |
|---|---|---|
| JP | 2001-209201 | 8/2001 |
| JP | 2006-221094 | 8/2006 |
| JP | 2010-175740 | 8/2010 |
| JP | 2013-130596 | 7/2013 |
| JP | 2013-137518 | 7/2013 |
| JP | 2014-186296 | 10/2014 |
| JP | 2016-028266 | 2/2016 |

* cited by examiner

ELECTROPHOTOGRAPHIC PHOTOSENSITIVE MEMBER, PROCESS CARTRIDGE, AND ELECTROPHOTOGRAPHIC APPARATUS

CROSS-REFERENCE TO RELATED APPLICATIONS

This application is a Continuation of International Patent Application No. PCT/JP2018/036856, filed Oct. 2, 2018, which claims the benefit of Japanese Patent Application No. 2017-193654, filed Oct. 3, 2017, both of which are hereby incorporated by reference herein in their entirety.

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

An electrophotographic photosensitive member including an undercoat layer and a photosensitive layer on a conductive support has been widely used as an electrophotographic photosensitive member used in an electrophotographic apparatus. The undercoat layer has functions to inhibit charge injection from the support and transport electrons generated in the photosensitive layer in addition to functions to conceal a defect of the support, suppress an interference fringe, and the like.

Along with the recent increase in sensitivity of a charge-generating substance contained in the photosensitive layer, a charge generation amount is increased, and charge is liable to be accumulated in the vicinity of an interface between the photosensitive layer and the undercoat layer, with the result that there is a problem in that a ghost phenomenon is liable to occur. Specifically, there is liable to occur a so-called positive ghost phenomenon in which only a portion, in which an image exposure history at a time of previous rotation remains, is increased in density in an output image.

As a technology for suppressing such ghost phenomenon, there has been known a technology for incorporating a metal oxide and an electron-transporting substance into the undercoat layer, to thereby suppress accumulation of charge.

In Japanese Patent Application Laid-Open No. 2006-221094, there is a disclosure of a technology for incorporating metal oxide particles, and a compound having an acceptor property, such as an anthraquinone compound, into the undercoat layer, and there is the following description. It is preferred that conductive metal oxide particles, such as tin oxide, titanium oxide, and zinc oxide, be used as the metal oxide particles. It is particularly preferred that the compound having an acceptor property have an anthraquinone structure capable of reacting with the metal oxide particles. When the acceptor property is imparted to the undercoat layer, the ghost phenomenon, a black spot-like image defect (hereinafter sometimes referred to as "black spot") caused by charge injection from the support to the photosensitive layer side, and an image quality defect, such as fogging, can be suppressed.

In Japanese Patent Application Laid-Open No. 2013-137518, there is a disclosure of a technology for incorporating metal oxide particles and a benzophenone compound having a hydroxy group or an amino group into the undercoat layer. It is assumed that the above-mentioned benzophenone compound having a substituent interacts with the metal oxide particles to smoothen the transfer of electrons between the metal oxide particles in the undercoat layer or from the photosensitive layer to the undercoat layer, to thereby suppress the ghost phenomenon.

The inventors have made investigations. As a result, it has been found that there is a problem in that the undercoat layer containing only aluminum oxide particles as the metal oxide particles is subject to significant dark decay under a low-temperature and low-humidity environment, to thereby generate a positive ghost image.

In view of the foregoing, in order to suppress the generation of a positive ghost image, aluminum oxide particles and titanium oxide particles were mixed as the metal oxide particles to be incorporated into the undercoat layer. In this case, the following has been found. The effect of suppressing the generation of a positive ghost image is achieved. However, when the weight ratio of the titanium oxide particles is increased, cracking is liable to occur under a high-temperature and high-humidity environment, with the result that it is difficult to satisfy both the suppression of the generation of a positive ghost image and the suppression of the occurrence of cracking.

Thus, an object of the present disclosure is to provide an electrophotographic photosensitive member in which the generation of a positive ghost image is suppressed under the low-temperature and low-humidity environment, and the occurrence of cracking is suppressed under the high-temperature and high-humidity environment.

In addition, another object of the present disclosure is to provide a process cartridge mounted with the electrophotographic photosensitive member, and an electrophotographic apparatus including the process cartridge.

SUMMARY OF THE INVENTION

The above-mentioned object is achieved by the following present disclosure.

The present disclosure relates to an electrophotographic photosensitive member including in this order: a support; an undercoat layer; and a photosensitive layer, wherein the undercoat layer contains metal oxide particles ($\alpha$) and a binder resin ($\beta$), wherein a mass ratio $M_\alpha/M_0$ between a content $M_\alpha$ of the metal oxide particles ($\alpha$) and a content $M_\beta$ of the binder resin ($\beta$) in the undercoat layer satisfies the following expression (A):

$$1.0 \leq M_\alpha/M_\beta \leq 4.0 \quad \text{(A)},$$

wherein the metal oxide particles ($\alpha$) contain at least aluminum oxide particles and titanium oxide particles, wherein a total of a content of the aluminum oxide particles and a content of the titanium oxide particles in the undercoat layer is 50 mass % or more with respect to the metal oxide particles ($\alpha$) in the undercoat layer, and wherein a mass ratio $M_{Al}/M_{Ti}$ between a content $M_{Al}$ of the aluminum oxide particles and a content $M_{Ti}$ of the titanium oxide particles in the undercoat layer satisfies the following expression (B):

$$0.25 \leq M_{Al}/M_{Ti} \leq 1{,}000 \quad \text{(B)}.$$

The present disclosure also relates to a process cartridge including: the electrophotographic photosensitive member; and at least one unit selected from the group consisting of a charging unit, a developing unit, and a cleaning unit, the process cartridge integrally supporting the electrophotographic photosensitive member and the at least one unit, and being removably mounted on a main body of an electrophotographic apparatus.

The present disclosure also relates to an electrophotographic apparatus including: the electrophotographic photosensitive member; and at least one unit selected from the group consisting of a charging unit, an exposing unit, a developing unit, and a transferring unit.

Further features of the present invention will become apparent from the following description of exemplary embodiments with reference to the attached drawings.

DESCRIPTION OF THE EMBODIMENTS

Figure 1:
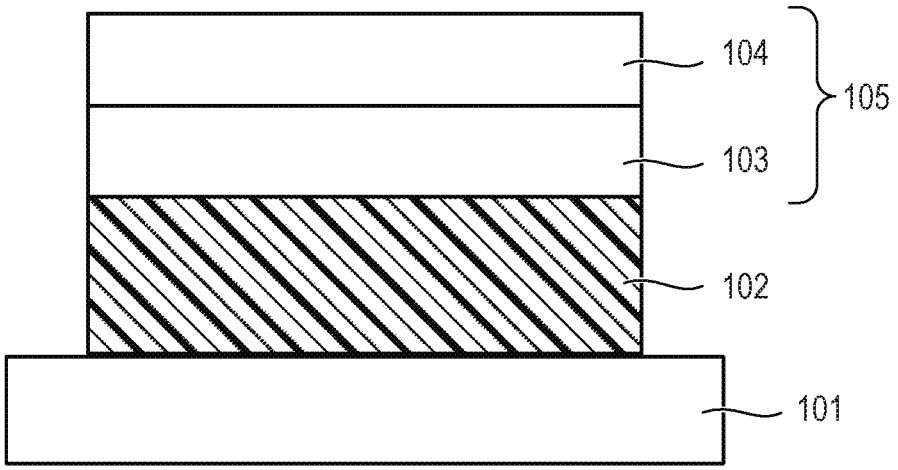
FIG. 1 is a schematic view for illustrating an example of a configuration of an electrophotographic photosensitive member according to at least one embodiment of the present disclosure.

The present disclosure relates to an electrophotographic photosensitive member including in this order: a support; an undercoat layer; and a photosensitive layer, wherein the undercoat layer contains metal oxide particles (α) and a binder resin ((3), wherein a mass ratio $M_\alpha/M_\beta$ between a content $M_\alpha$ of the metal oxide particles (α) and a content $M_\beta$ of the binder resin (β) in the undercoat layer satisfies the following expression (A):

$$1.0 \leq M_\alpha/M_\beta \leq 4.0 \quad \text{(A)},$$

wherein the metal oxide particles (α) contain at least aluminum oxide particles and titanium oxide particles, wherein a total of a content of the aluminum oxide particles and a content of the titanium oxide particles in the undercoat layer is 50 mass % or more with respect to the metal oxide particles (α) in the undercoat layer, and wherein a mass ratio $M_{Al}/M_{Ti}$ between a content $M_{Al}$ of the aluminum oxide particles and a content $M_{Ti}$ of the titanium oxide particles in the undercoat layer satisfies the following expression (B):

$$0.25 \leq M_{Al}/M_{Ti} \leq 1{,}000 \quad \text{(B)}.$$

Regarding the reason that the electrophotographic photosensitive member according to at least one embodiment of the present disclosure is excellent in suppression of the generation of a positive ghost image under the low-temperature and low-humidity environment and in suppression of the occurrence of cracking under the high-temperature and high-humidity environment, inventors presume the following.

In at least one embodiment of the present disclosure, the metal oxide particles contained in the undercoat layer, that is, the aluminum oxide particles and the titanium oxide particles serve to impart conductivity to the undercoat layer. In this case, titanium oxide has conductivity higher than that of aluminum oxide. Therefore, when the aluminum oxide particles and the titanium oxide particles are mixed with each other and incorporated into the undercoat layer, an undercoat layer having conductivity higher than that of an undercoat layer containing only the aluminum oxide particles is obtained. Thus, when the aluminum oxide particles and the titanium oxide particles are mixed with each other and incorporated into the undercoat layer, the amount of charge to be accumulated in the undercoat layer is reduced, and an increase in dark decay amount can be suppressed even under the low-temperature and low-humidity environment, with the result that the generation of a positive ghost image can be suppressed. From the viewpoint of suppressing the generation of a positive ghost image, the mass ratio $M_{Al}/M_{Ti}$ between the content $M_{Al}$ of the aluminum oxide particles and the content $M_{Ti}$ of the titanium oxide particles is required to be 1,000 or less, preferably 10 or less.

However, it has been found from the results of the investigations made by the inventors that, when the mass ratio of the titanium oxide particles in the undercoat layer is increased, that is, when the mass ratio $M_{Al}/M_{Ti}$ is decreased, cracking is liable to occur. From the viewpoint of suppressing the occurrence of cracking, the mass ratio $M_{Al}/M_{Ti}$ is required to be 0.25 or more, preferably 0.5 or more.

Specifically, when the mass ratio between the aluminum oxide particles and the titanium oxide particles contained in the undercoat layer of the electrophotographic photosensitive member according to at least one embodiment of the present disclosure is set to a specific value, the aluminum oxide particles and the titanium oxide particles are uniformly dispersed in the undercoat layer. It is presumed that, with such undercoat layer, conductivity is satisfactory even under the low-temperature and low-humidity environment, and an undercoat layer in which cracking is less liable to occur even under the high-temperature and high-humidity environment can be formed. It is presumed that, when such undercoat layer is formed, an electrophotographic photosensitive member in which both the suppression of the generation of a positive ghost image and the suppression of the occurrence of cracking are satisfied can be obtained.

A mode for carrying out the present disclosure is described below in detail.

[Electrophotographic Photosensitive Member]

The electrophotographic photosensitive member according to at least one embodiment of the present disclosure has a configuration in which an undercoat layer, a charge-generating layer, and a charge-transporting layer are laminated on a support in the stated order. If required, a conductive layer may be arranged between the charge-generating layer and the support, and a protective layer may be arranged on the charge-transporting layer. In at least one embodiment of the present disclosure, the charge-generating layer and the charge-transporting layer are collectively referred to as "photosensitive layer".

In FIG. 1, there is illustrated an example of a layer configuration of the electrophotographic photosensitive member according to at least one embodiment of the present disclosure. In FIG. 1, an undercoat layer 102, a charge-generating layer 103, and a charge-transporting layer 104 are laminated on a support 101. Specifically, in FIG. 1, there is illustrated the electrophotographic photosensitive member including a laminated photosensitive layer 105 in which the charge-generating layer 103 and the charge-transporting layer 104 are laminated.

The electrophotographic photosensitive member according to at least one embodiment of the present disclosure contains a charge-transporting substance in a surface layer. The surface layer in the electrophotographic photosensitive member according to at least one embodiment of the present disclosure refers to the protective layer when the electrophotographic photosensitive member includes the protective layer, and refers to the charge-transporting layer when the protective layer is not arranged. In addition, the photosensitive layer may be formed of a single-layer photosensitive layer containing a charge-generating substance and the charge-transporting substance.

A method of producing the electrophotographic photosensitive member according to at least one embodiment of the present disclosure is, for example, a method involving: preparing coating liquids for the respective layers to be described later; applying the liquids in a desired order of the layers; and drying the liquids. In this case, examples of the method of applying each of the coating liquids include dip coating, spray coating, inkjet coating, roll coating, die coating, blade coating, curtain coating, wire bar coating, and ring coating. Of those, dip coating is preferred from the viewpoints of efficiency and productivity.

Now, the configuration of the electrophotographic photosensitive member according to at least one embodiment of the present disclosure is described.

<Support>

In at least one embodiment of the present disclosure, the support is preferably a conductive support having conductivity. In addition, examples of the shape of the support include a cylindrical shape, a belt shape, and a sheet shape. Of those, a cylindrical support is preferred. In addition, the surface of the support may be subjected to, for example, an electrochemical treatment, such as anodization, a blast treatment, or a cutting treatment.

A metal, a resin, glass, or the like is preferred as a material for the support. Examples of the metal include aluminum, iron, nickel, copper, gold, stainless steel, and alloys thereof. Of those, an aluminum support using aluminum is preferred. In addition, conductivity is preferably imparted to the resin or the glass through a treatment involving, for example, mixing or coating the resin or the glass with a conductive material.

<Conductive Layer>

In the electrophotographic photosensitive member according to at least one embodiment of the present disclosure, the conductive layer may be arranged on the support. The arrangement of the conductive layer can conceal flaws and irregularities in the surface of the support, and control the reflection of light on the surface of the support. The conductive layer preferably contains conductive particles and a resin. A material for the conductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver. Of those, the metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element, such as phosphorus or aluminum, or an oxide thereof. In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a concealing agent, such as a silicone oil, resin particles, or titanium oxide.

The conductive layer may be formed by preparing a coating liquid for a conductive layer containing the above-mentioned respective materials and a solvent, forming a coat thereof on the support, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

The conductive layer has an average thickness of preferably 1 μm or more and 50 μm or less, particularly preferably 3 μm or more and 40 μm or less.

<Undercoat Layer>

In the electrophotographic photosensitive member according to at least one embodiment of the present disclosure, the undercoat layer is arranged between the support or the conductive layer, and the photosensitive layer. The undercoat layer may be formed by applying a coating liquid for an undercoat layer containing the metal oxide particles (α), the binder resin (β), and a solvent onto the support or the conductive layer to form a coat, and drying the coat.

The metal oxide particles contain at least aluminum oxide particles and titanium oxide particles, and may be used under a state in which other metal oxide particles are further mixed therein. In this case, the total of the content of the aluminum oxide particles and the content of the titanium oxide particles in the undercoat layer is 50 mass % or more with respect to the metal oxide particles (α) in the undercoat layer, and the mass ratio $M_{Al}/M_{Ti}$ between the aluminum oxide particles and the titanium oxide particles in the undercoat layer is 0.25 or more and 1,000 or less.

The metal oxide particles contained in the undercoat layer may be used after having been surface-treated with a surface treatment agent, such as a silane coupling agent, in order to suppress a black spot. In this case, a compound represented by the following formula (1) may be used as the silane coupling agent.

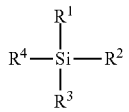

(1)

In the formula (1), $R^1$ to $R^3$ each independently represent an alkoxy group or an alkyl group, provided that at least two of $R^1$ to $R^3$ each represent an alkoxy group, $R^4$ represents an alkyl group having "n" carbon atoms, and "n" represents an integer of 6 or more and 18 or less.

Examples of the compound represented by the formula (1) include hexyltrimethoxysilane, hexyltriethoxysilane, octyltrimethoxysilane, octyltriethoxysilane, decyltrimethoxysilane, dodecyltrimethoxysilane, dodecyltriethoxysilane, hexadecyltrimethoxysilane, octadecyltrimethoxysilane, and octadecyltriethoxysilane.

In addition, a silane coupling agent other than the compound represented by the formula (1), such as N-2-(aminoethyl)-3-aminopropylmethyldimethoxysilane, 3-aminopropylmethyldiethoxysilane, (phenylaminomethyl) methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, vinyltrimethoxysilane, 3-aminopropyltriethoxysane, N-(2-aminoethyl)-3-aminopropyltrimethoxysilane, methyltrimethoxysilane, 3-glycidoxypropyltrimethoxysilane, 3-methacryloxypropyltrimethoxysilane, 3-chloropropyltrimethoxysilane, or 3-mercaptopropyltrimethoxysilane, may be used as the silane coupling agent.

Of those, the compound represented by the formula (1) is preferably used for the aluminum oxide particles. Further, the compound represented by the formula (1) in which the number "n" of carbon atoms of $R^4$ is an integer of 6 or more and 12 or less is preferably used, and octyltriethoxysilane is particularly preferably used. In addition, N-2-(aminoethyl)-3-aminopropylmethyldimethoxysilane is preferably used for the titanium oxide particles.

A general method is used as a method of surface-treating the metal oxide particles. Examples thereof include a dry method and a wet method.

The dry method involves: adding an alcohol aqueous solution, organic solvent solution, or aqueous solution containing a surface treatment agent to metal oxide particles while stirring the metal oxide particles in a mixer capable of stirring the metal oxide particles at a high speed, for example, a Henschel mixer; and uniformly dispersing the metal oxide particles, followed by the drying of the resultant.

In addition, the wet method involves: stirring metal oxide particles and a surface treatment agent in a solvent or dispersing the metal oxide particles and the surface treatment agent in the solvent with a sand mill or the like through use of glass beads or the like; and removing the solvent by filtration or vacuum distillation after the dispersion. It is preferred that, after the solvent is removed, baking be further performed at 100° C. or more.

A surface treatment amount X (mass %) of the compound represented by the formula (1) with respect to the metal oxide particles may be measured through use of, for example, a wavelength dispersion-type fluorescent X-ray analyzer (product name: Axios) manufactured by Spectris Co., Ltd. A scraped-off undercoat layer, which is obtained by peeling the photosensitive layer of the electrophotographic photosensitive member and the undercoat layer thereof, as required, and scraping off the undercoat layer, may be used as an object to be measured. In addition, the surface-treated metal oxide particles used in the undercoat layer may be used.

In this case, the surface treatment amount X is defined as a value calculated by the following expression from a mass ratio $M'_{Si}/M'_{Al}$, where $M'_{Al}$ represents a mass of aluminum atoms in the surface-treated aluminum oxide particles, and $M'_{Si}$ represents a mass of silicon atoms derived from the compound represented by the formula (1).

$$X=(M'_{Si}/M'_{Al})\times 100(\text{mass }\%)$$

When the metal oxide particles are surface-treated so that a value (X×n) obtained by multiplying X determined by the above-mentioned expression by the number "n" of carbon atoms of the alkyl group represented by $R^4$ in the compound represented by the formula (1) is 10 or more and 330 or less, an undercoat layer excellent in both the suppression of the generation of a black spot and the suppression of potential variation can be obtained. Further, it is preferred that the value of (X×n) be 10 or more and 220 or less because the electrophotographic photosensitive member according to at least one embodiment of the present disclosure exhibits more excellent effects.

Examples of the binder resin to be incorporated into the undercoat layer include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin. Of those, a polyurethane resin is preferably used.

Examples of the polymerizable functional group of a monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group. Of those, a blocked isocyanate group is preferred.

The mass ratio ($M_\alpha/M_\beta$) between the metal oxide particles (α) and the binder resin (β) in the undercoat layer is 1.0 or more and 4.0 or less.

The undercoat layer may further contain an additive. Known materials, for example, powder of a metal, such as aluminum, a conductive substance, such as carbon black, a charge-transporting substance, a metal chelate compound, and an organic metal compound may each be incorporated into the undercoat layer.

Examples of the charge-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. A charge-transporting substance having a polymerizable functional group may be used as the charge-transporting substance and copolymerized with the above-mentioned monomer having a polymerizable functional group to form the undercoat layer as a cured film.

The undercoat layer may be formed by preparing a coating liquid for an undercoat layer containing the above-mentioned respective materials and a solvent, forming a coat thereof on the support or the conductive layer, and drying and/or curing the coat.

Examples of the solvent to be used for the coating liquid for an undercoat layer include organic solvents, such as an alcohol, a sulfoxide, a ketone, an ether, an ester, an aliphatic halogenated hydrocarbon, and an aromatic compound. In at least one embodiment of the present disclosure, an alcohol-based or ketone-based solvent is preferably used.

As a dispersion method for preparing the coating liquid for an undercoat layer, there are given methods using a homogenizer, an ultrasonic disperser, a ball mill, a sand mill, a roll mill, a vibration mill, an attritor, and a liquid collision-type high-speed disperser.

The average thickness of the undercoat layer is preferably 0.1 μm or more and 30 μm or less, more preferably 0.1 μm or more and 10 μm or less, particularly preferably 0.3 μm or more and 5 μm or less.

<Photosensitive Layer>

The photosensitive layers of electrophotographic photosensitive members are mainly classified into (1) a laminated photosensitive layer and (2) a single-layer photosensitive layer. (1) The laminated photosensitive layer is a photosensitive layer having a charge-generating layer containing a charge-generating substance and a charge-transporting layer containing a charge-transporting substance. (2) The single-layer photosensitive layer is a photosensitive layer containing both a charge-generating substance and a charge-transporting substance.

(1) Laminated Photosensitive Layer

The laminated photosensitive layer has the charge-generating layer and the charge-transporting layer.

(1-1) Charge-Generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer may be formed by preparing a coating liquid for a charge-generating layer containing the above-mentioned respective materials and a solvent, forming a coat thereof on the undercoat layer, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

The charge-generating layer has an average thickness of preferably 0.1 μm or more and 1 μm or less, more preferably 0.15 μm or more and 0.4 μm or less.

(1-2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer may be formed by preparing a coating liquid for a charge-transporting layer containing the above-mentioned respective materials and a solvent, forming a coat thereof on the charge-generating layer, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

The charge-transporting layer has an average thickness of preferably 5 μm or more and 50 μm or less, more preferably 8 μm or more and 40 μm or less, particularly preferably 10 μm or more and 30 μm or less.

(2) Single-Layer Photosensitive Layer

The single-layer photosensitive layer may be formed by preparing a coating liquid for a photosensitive layer containing the charge-generating substance, the charge-transporting substance, a resin, and a solvent, forming a coat thereof on the undercoat layer, and drying the coat. Examples of the charge-generating substance, the charge-transporting substance, and the resin are the same as those of the materials in the section "(1) Laminated Photosensitive Layer."

<Protective Layer>

In at least one embodiment of the present disclosure, a protective layer may be arranged on the photosensitive layer. The arrangement of the protective layer can improve durability.

It is preferred that the protective layer contain the charge-transporting substance, and further contain conductive particles and a resin.

Examples of the conductive particles include particles of metal oxides, such as titanium oxide, zinc oxide, tin oxide, and indium oxide.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

In addition, the protective layer may be formed as a cured film by polymerizing a composition containing a monomer having a polymerizable functional group. As a reaction in this case, there are given, for example, a thermal polymerization reaction, a photopolymerization reaction, and a radiation polymerization reaction. Examples of the polymerizable functional group of the monomer having a polymerizable functional group include an acryl group and a methacryl group. A monomer having a charge-transporting ability may be used as the monomer having a polymerizable functional group.

The protective layer may contain an additive, such as an antioxidant, a UV absorber, a plasticizer, a leveling agent, a lubricity-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The protective layer may be formed by preparing a coating liquid for a protective layer containing the above-mentioned respective materials and a solvent, forming a coat thereof on the photosensitive layer, and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

The protective layer has an average thickness of preferably 0.5 μm or more and 10 μm or less, more preferably 1 μm or more and 7 μm or less.

<Surface Processing of Electrophotographic Photosensitive Member>

In at least one embodiment of the present disclosure, the electrophotographic photosensitive member may be subjected to surface processing. When the surface processing is performed, the behavior of a cleaning unit (cleaning blade) that is brought into contact with the electrophotographic photosensitive member can be further stabilized. As a method for the surface processing, there are given a method involving bringing a mold having a protrusion into pressure-contact with the surface of the electrophotographic photosensitive member, to thereby perform shape transfer, and a method involving imparting an irregular shape through mechanical abrasion. Thus, through the arrangement of recesses or protrusions on the surface layer of the electrophotographic photosensitive member, the behavior of the cleaning unit that is brought into contact with the electrophotographic photosensitive member can be further stabilized.

The recesses or the protrusions may be formed over an entire region of the surface of the electrophotographic photosensitive member or in a part of the surface of thereof. When the recesses or the protrusions are formed in a part of the surface of the electrophotographic photosensitive member, it is preferred that the recesses or the protrusions be formed at least in an entire contact region between the electrophotographic photosensitive member and the cleaning unit (cleaning blade).

When the recesses are formed, the recesses can be formed on the surface of the electrophotographic photosensitive member by bringing a mold having protrusions corresponding to the recesses into pressure-contact with the surface of the electrophotographic photosensitive member, to thereby perform shape transfer.

<Method of Forming Recesses on Peripheral Surface of Electrophotographic Photosensitive Member>

Recesses can be formed on a peripheral surface of the electrophotographic photosensitive member by bringing a mold having protrusions corresponding to recesses to be formed into pressure-contact with the peripheral surface of the electrophotographic photosensitive member, to thereby perform shape transfer.

Figure 2:
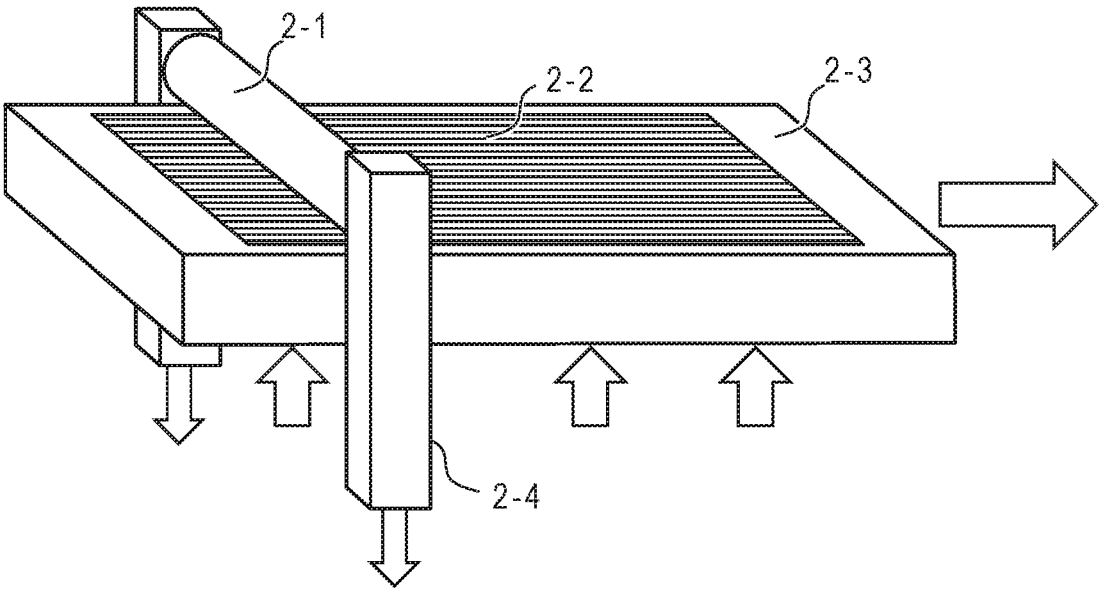
FIG. 2 is a view for illustrating an example of a pressure-contact shape transfer processing apparatus for forming recesses on a peripheral surface of the electrophotographic photosensitive member.

In FIG. 2, there is illustrated an example of a pressure-contact shape transfer processing apparatus for forming recesses on the peripheral surface of the electrophotographic photosensitive member.

With the pressure-contact shape transfer processing apparatus illustrated in FIG. 2, a mold 2-2 is continuously brought into contact with a peripheral surface of an electrophotographic photosensitive member 2-1 that is an object to be processed to pressurize the electrophotographic photosensitive member while the electrophotographic photosensitive member is rotated. With this, recesses and flat portions can be formed on the peripheral surface of the electrophotographic photosensitive member 2-1.

As a material for a pressurizing member 2-3, there are given, for example, a metal, a metal oxide, plastic, and glass. Of those, stainless steel (SUS) is preferred from the viewpoints of mechanical strength, dimensional accuracy, and durability. The mold 2-2 is arranged on an upper surface of the pressurizing member 2-3. In addition, through use of a support member (not shown) installed on a lower surface side and a pressurizing system (not shown), the mold 2-2 can be brought into contact with the peripheral surface of the electrophotographic photosensitive member 2-1 supported by a support member 2-4 with a predetermined pressure. In addition, the support member 2-4 may be pressed against the pressurizing member 2-3 with a predetermined pressure, or the support member 2-4 and the pressurizing member 2-3 may be pressed against each other.

The example illustrated in FIG. 2 is an example in which the peripheral surface of the electrophotographic photosensitive member 2-1 is continuously processed while the electrophotographic photosensitive member 2-1 is rotated in association with the pressurizing member 2-3, or is driven to be rotated, by moving the pressurizing member 2-3 in a direction perpendicular to an axis direction of the electrophotographic photosensitive member 2-1. Further, the peripheral surface of the electrophotographic photosensitive member 2-1 may also be continuously processed by: fixing the pressurizing member 2-3 and moving the support member 2-4 in the direction perpendicular to the axis direction of the electrophotographic photosensitive member 2-1; or moving both the support member 2-4 and the pressurizing member 2-3.

It is preferred that the mold 2-2 and the electrophotographic photosensitive member 2-1 be heated from the viewpoint of efficiently performing shape transfer.

Examples of the mold 2-2 include: a metal and a resin film each subjected to fine surface processing; a silicon wafer or the like having a surface patterned with a resist; a resin film having fine particles dispersed therein; and a resin film with a fine surface shape having a metal coating applied thereto.

In addition, from the viewpoint of uniformizing the pressure applied to the electrophotographic photosensitive member 2-1, it is preferred that an elastic body be arranged between the mold 2-2 and the pressurizing member 2-3.

The recesses, the flat portions, the protrusions, and the like on the peripheral surface of the electrophotographic photosensitive member may be observed through use of, for example, a microscope, such as a laser microscope, an optical microscope, an electron microscope, or an atomic force microscope.

For example, the following devices may each be used as the laser microscope: an ultra-deep shape measuring microscope VK-8550, an ultra-deep shape measuring microscope VK-9000, and ultra-deep shape measuring microscopes VK-9500, VK-X200, and VK-X100 manufactured by Keyence Corporation; a scanning confocal laser microscope OLS3000 manufactured by Olympus Corporation; and a real color confocal microscope OPTELICS C130 manufactured by Lasertec Corporation.

For example, the following devices may be each used as the optical microscope: a digital microscope VHX-500 and a digital microscope VHX-200 manufactured by Keyence Corporation; and a 3D digital microscope VC-7700 manufactured by OMRON Corporation.

For example, the following devices may each be used as the electron microscope: a 3D real surface view microscope VE-9800 and a 3D real surface view microscope VE-8800 manufactured by Keyence Corporation; a scanning electron microscope Conventional/Variable Pressure SEM manufactured by SII Nano Technology Inc.; and a scanning electron microscope SUPERSCAN SS-550 manufactured by Shimadzu Corporation.

For example, the following devices may each be used as the atomic force microscope: a nanoscale hybrid microscope VN-8000 manufactured by Keyence Corporation; a scanning probe microscope NanoNavi station manufactured by SII Nano Technology Inc.; and a scanning probe microscope SPM-9600 manufactured by Shimadzu Corporation.

Figure 3:
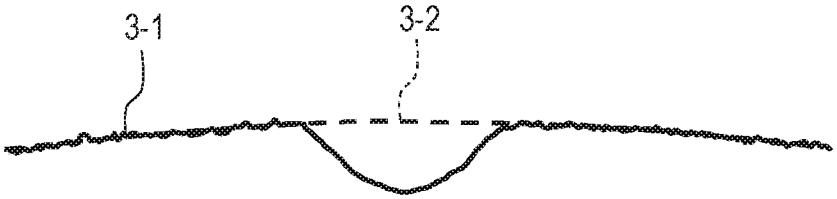
FIG. 3 is a view for illustrating an example of fitting.

Now, a method of observing recesses on the peripheral surface of the electrophotographic photosensitive member is described. First, magnified observation of the peripheral surface of the electrophotographic photosensitive member is performed through use of a microscope. The peripheral surface of the electrophotographic photosensitive member is a curved surface curved in a circumferential direction. Therefore, a cross-sectional profile of the curved surface is extracted, and is subjected to curved line (arc) fitting. In FIG. 3, there is illustrated an example of the fitting. The example illustrated in FIG. 3 is an exemplary case in which the electrophotographic photosensitive member has a cylindrical shape. In FIG. 3, the solid line represents a cross-sectional profile 3-1 of the peripheral surface (curved surface) of the electrophotographic photosensitive member, and the broken line represents a curved line 3-2 fitted to the cross-sectional profile 3-1. The cross-sectional profile 3-1 is corrected so that the curved line 3-2 fitted to the cross-sectional profile 3-1 becomes a straight line, and a surface obtained by extending the obtained straight line in a longitudinal direction (direction orthogonal to the circumferential direction) of the electrophotographic photosensitive member is defined as a reference surface. Also in the case where the electrophotographic photosensitive member does not have a cylindrical shape, a reference surface is obtained in the same manner as in the case where the electrophotographic photosensitive member has a cylindrical shape.

Figure 4:
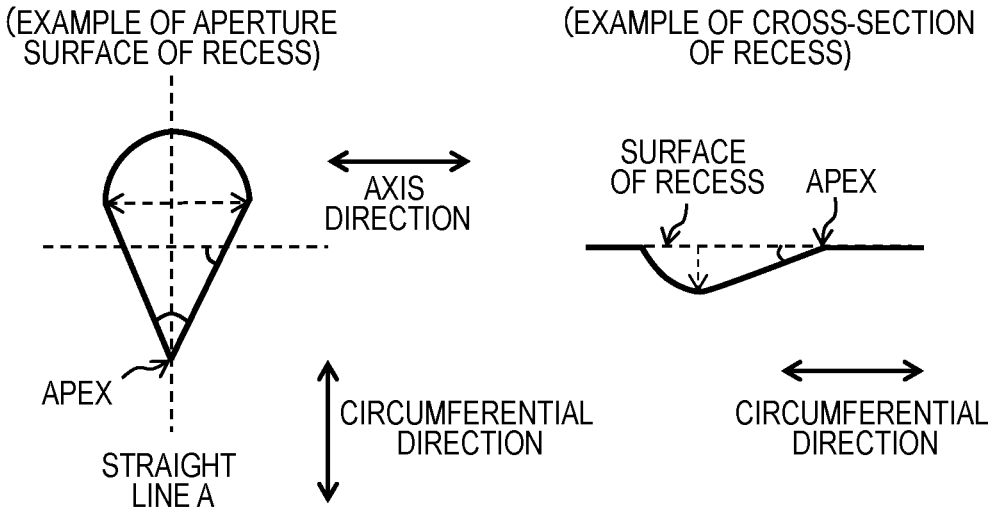
FIG. 4 is a view for schematically illustrating an aperture surface and a cross-section of the recess formed on the peripheral surface of the electrophotographic photosensitive member.
Figures 5A, 5B, 5C, 5D, 5E:
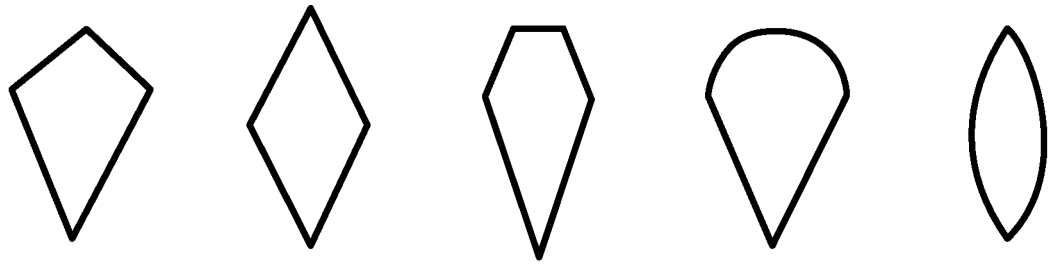
FIGS. 5A, 5B, 5C, 5D, 5E, 5F, 5G, 5H, 5I and 5J are views for illustrating examples of a shape of an aperture portion of the recess formed on the peripheral surface of the electrophotographic photosensitive member.
Figures 5F, 5G, 5H, 5I, 5J:
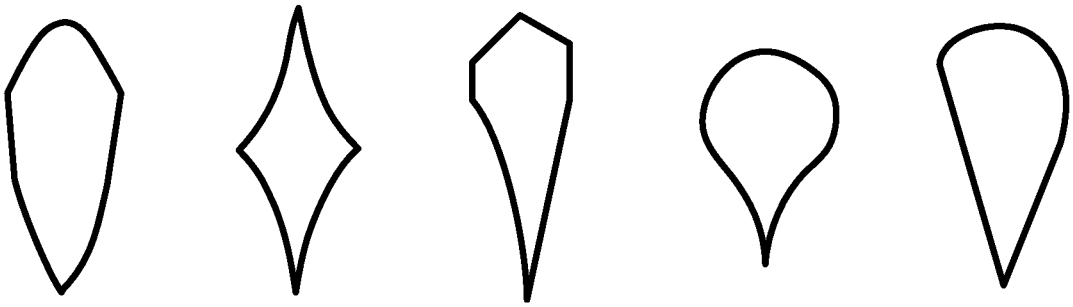
Figure 6A:
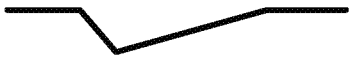
FIGS. 6A, 6B, 6C, 6D, 6E, 6F, 6G and 6H are views for illustrating examples of a shape of the cross-section of the recess formed on the peripheral surface of the electrophotographic photosensitive member.
Figure 6B:
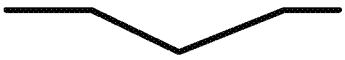
Figure 6C:
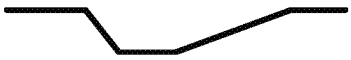
Figure 6D:
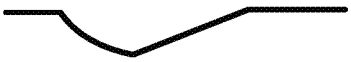
Figure 6E:
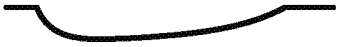
Figure 6F:
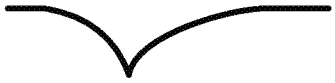
Figure 6G:
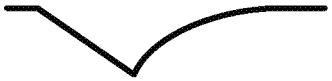
Figure 6H:
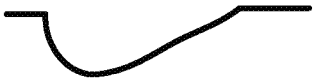

In FIG. 4, there are illustrated an example of an aperture surface of a recess formed on the peripheral surface of the electrophotographic photosensitive member and an example of a cross-section of the recess when viewed from the circumferential direction. The example of the cross-section of the recess in FIG. 4 is a cross-sectional profile after the above-mentioned correction.

In FIGS. 5A to 5J, there are illustrated examples of a shape of an aperture portion of the recess.

In FIGS. 6A to 6H, there are illustrated examples of a shape of the cross-section of the recess.

[Process Cartridge and Electrophotographic Apparatus]

A process cartridge according to at least one embodiment of the present disclosure is characterized in that the process cartridge integrally supports the electrophotographic photosensitive member described in the foregoing, and at least one unit selected from the group consisting of a charging unit, a developing unit, a transferring unit, and a cleaning unit, and is removably mounted on the main body of an electrophotographic apparatus.

In addition, an electrophotographic apparatus according to at least one embodiment of the present disclosure is characterized by including the electrophotographic photosensitive member described in the foregoing, and at least one unit selected from the group consisting of a charging unit, an exposing unit, a developing unit, and a transferring unit.

Figure 7:
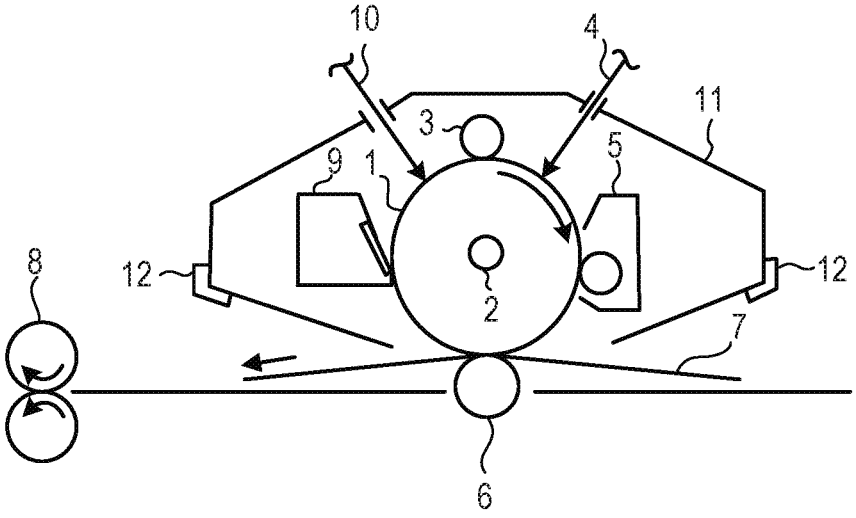
FIG. 7 is a view for illustrating an example of a schematic configuration of a process cartridge mounted with the electrophotographic photosensitive member according to at least one embodiment of the present disclosure, and an electrophotographic apparatus including the process cartridge.

An example of the schematic configuration of an electrophotographic apparatus including a process cartridge including an electrophotographic photosensitive member is illustrated in FIG. 7.

A cylindrical (drum-shaped) electrophotographic photosensitive member 1 is rotationally driven about a shaft 2 in a direction indicated by the arrow at a predetermined peripheral speed (process speed). The surface of the electrophotographic photosensitive member 1 is charged to a predetermined positive or negative potential by a charging unit 3 in the rotation process. In FIG. 7, a roller charging system based on a roller-type charging member is illustrated, but a charging system such as a corona charging system, a proximity charging system, or an injection charging system may be adopted. The charged surface of the electrophotographic photosensitive member 1 is irradiated with exposure light 4 from an exposing unit (not shown), and hence an electrostatic latent image corresponding to target image information is formed thereon. The exposure light 4 is light having intensity modulated in conformity with a time-series electric digital image signal of the target image information, and is output from, for example, an image exposing unit, such as slit exposure or laser beam scanning exposure. The electrostatic latent image formed on the surface of the electrophotographic photosensitive member 1 is developed (regular development or reversal development) with a toner stored in a developing unit 5, and a toner image is formed on the surface of the electrophotographic photosensitive member 1.

The toner image formed on the surface of the electrophotographic photosensitive member 1 is transferred onto a transfer material 7 by a transferring unit 6. In this case, a bias voltage having polarity opposite to that of retained charge of the toner is applied to the transferring unit 6 from a bias power source (not shown). In addition, when the transfer material 7 is paper, the transfer material 7 is taken out from a feeding portion (not shown) and fed to a space between the electrophotographic photosensitive member 1 and the transferring unit 6 in synchronization with the rotation of the electrophotographic photosensitive member 1. The transfer material 7 onto which the toner image has been transferred from the electrophotographic photosensitive member 1 is separated from the surface of the electrophotographic photosensitive member 1, is conveyed to a fixing unit 8, is subjected to treatment for fixing the toner image, and is printed out as an image-formed product (print or copy) to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. In at least one embodiment of the present disclosure, of components selected from the electrophotographic photosensitive member 1, the charging unit 3, the developing unit 5, the cleaning unit 9, and the like, a plurality of the components are stored in a container and integrally supported to form a process cartridge, and the process cartridge may be removably mounted on a main body of the electrophotographic apparatus. For example, the process cartridge may be configured as described below. At least one selected from the charging unit 3, the developing unit 5, and the cleaning unit 9 is integrally supported together with the electrophotographic photosensitive member 1 to form a cartridge. The cartridge may be formed into a process cartridge 11 that is removably mounted on the main body of the electrophotographic apparatus through use of a guiding unit 12, such as a rail of the main body of the electrophotographic apparatus. The electrophotographic apparatus may include an electricity-removing mechanism configured to subject the surface of the electrophotographic photosensitive member 1 to electricity-removing treatment with pre-exposure light 10 from a pre-exposing unit (not shown). In addition, the guiding unit 12, such as a rail, may be arranged for removably mounting the process cartridge 11 according to at least one embodiment of the present disclosure on the main body of the electrophotographic apparatus. The electrophotographic apparatus according to at least one embodiment of the present disclosure is characterized by including the electrophotographic photosensitive member 1 and at least one unit selected from the group consisting of the charging unit 3, the exposing unit, the developing unit 5, and the transferring unit 6.

The electrophotographic photosensitive member according to at least one embodiment of the present disclosure may be used in, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description in the following Examples, "part(s)" is by mass unless otherwise specified.

Example 1

<Production of Electrophotographic Photosensitive Member Before Formation of Surface Shape>

Support

A cylindrical aluminum cylinder (HS-A3003, aluminum alloy having a diameter of 30 mm, a length of 357.5 mm, and a thickness of 0.7 mm) having a surface subjected to cutting treatment under the following conditions was used as a support (conductive support). The cutting conditions were as follows: a cutting tool of R0.1 was used, the revolution number of a main shaft was set to 10,000 rpm, and the feed speed of the cutting tool was continuously changed within a range of from 0.03 mm/rpm to 0.06 mm/rpm. The aluminum cylinder subjected to surface processing as described above was used as the support of an electrophotographic photosensitive member.

Formation of Undercoat Layer

100 Parts of aluminum oxide particles (average primary particle diameter: 13 nm, specific surface area: 99 $m^2/g$) were mixed with 500 parts of toluene under stirring, and 0.71 part of octyltriethoxysilane (product name: KBE-3083, manufactured by Shin-Etsu Chemical Co., Ltd.) was added to the resultant, followed by stirring for 6 hours. After that, toluene was removed by distillation under reduced pressure, and the residue was dried by heating at 140° C. for 6 hours to provide surface-treated aluminum oxide particles M1. A surface treatment amount X of the surface-treated aluminum oxide particles M1 and X×n are as shown in Table 1. The surface treatment amount X of the aluminum oxide particles M1 was obtained by producing an electrophotographic photosensitive member by a method described later, then scraping off an undercoat layer, and measuring the surface treatment amount X through use of a wavelength dispersion-type fluorescent X-ray analyzer (product name: Axios) manufactured by Spectris Co., Ltd.

The following titanium oxide particles coated with 10% of inorganic silica (hereinafter sometimes referred to as "silica-coated titanium oxide particles") were used as titanium oxide particles. 100 Parts of the silica-coated titanium oxide particles (product name: TKP-101, manufactured by Tayca Corporation, average primary particle diameter: 6 nm, specific surface area: 300 $m^2/g$) were mixed with 500 parts of toluene under stirring, and 0.32 part of N-2-(aminoethyl)-3-aminopropylmethyldimethoxysilane (product name: KBM-602, manufactured by Shin-Etsu Chemical Co., Ltd.) was added to the resultant, followed by stirring for 1 hour. After that, toluene was removed by distillation under reduced pressure, and the residue was dried by heating at 130° C. for 6 hours to provide surface-treated titanium oxide particles N1.

Next, 15 parts of butyral (product name: BM-1, manufactured by Sekisui Chemical Co., Ltd.) serving as polyol and 15 parts of blocked isocyanate (product name: Sumidur 3175, manufactured by Sumika Covestro Urethane Co., Ltd. (former Sumitomo Bayer Urethane Co., Ltd.), non-volatile content: 75%, block agent: oxime-based agent) were dissolved in a mixed solvent of 90 parts of methyl ethyl ketone and 90 parts of 1-butanol. 40.5 Parts of the surface-treated aluminum oxide particles M1, 13.5 parts of the surface-treated titanium oxide particles N1, and 0.28 part of 2,3,4-trihydroxybenzophenone (manufactured by Wako Pure Chemical Industries, Ltd.) were added to the solution obtained as described above, and were dispersed therein under an atmosphere of 23±3° C. for 3 hours with a sand mill apparatus using glass beads each having a diameter of 0.8 mm. After the dispersion treatment, 0.01 part of a silicone oil (product name: SH28PA, manufactured by Dow Corning Toray Co., Ltd. (former Toray Dow Corning Silicone Co., Ltd.)) was added to the resultant, and the mixture was stirred to prepare a coating liquid for an undercoat layer.

The obtained coating liquid for an undercoat layer was applied onto the support by dip coating to form a coat, and the coat was dried at 160° C. for 30 minutes to form an undercoat layer having a thickness of 2 μm. Mass ratios $M_\alpha/M_\beta$ and $M_{Al}/M_{Ti}$ in the undercoat layer are as shown in Table 1.

Formation of Charge-Generating Layer

Next, 4 parts of a hydroxygallium phthalocyanine crystal of a crystal form having strong peaks at Bragg angles 2θ±0.2° in CuKα characteristic X-ray diffraction of 7.4° and 28.1° (charge-generating substance), and 0.04 part of a compound represented by the following structural formula (A) were added to a solution obtained by dissolving 2 parts of polyvinyl butyral (product name: S-LEC BX-1, manufactured by Sekisui Chemical Co., Ltd.) in 100 parts of cyclohexanone. Then, the resultant was subjected to dispersion treatment under an atmosphere of 23±3° C. for 1 hour with a sand mill using glass beads each having a diameter of 1 mm. After the dispersion treatment, 100 parts of ethyl acetate was added to the resultant to prepare a coating liquid for a charge-generating layer.

The coating liquid for a charge-generating layer was applied onto the undercoat layer by dip coating, and the resultant coat was dried at 90° C. for 10 minutes to form a charge-generating layer having a thickness of 0.15 μm.

(A)

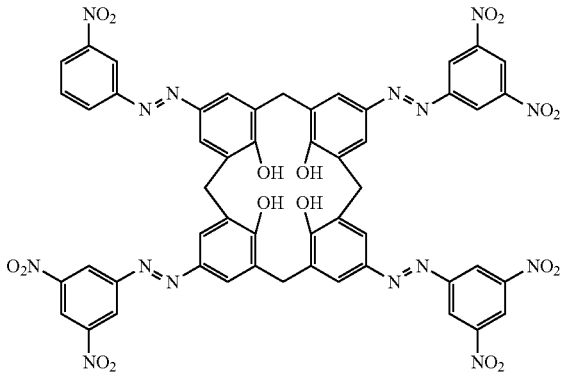

Formation of Charge-Transporting Layer

Next, 60 parts of a compound represented by the following structural formula (B), 30 parts of a compound represented by the following structural formula (C), 10 parts of a compound represented by the following structural formula (D), 100 parts of a bisphenol Z-type polycarbonate resin (product name: Iupilon Z400, manufactured by Mitsubishi Engineering-Plastics Corporation), and 0.2 part of polycarbonate having structural units represented by the following formula (E) (viscosity-average molecular weight Mv: 20,000) were dissolved in a mixed solvent of 272 parts of o-xylene, 256 parts of methyl benzoate, and 272 parts of dimethoxymethane to prepare a coating liquid for a charge-transporting layer.

The coating liquid for a charge-transporting layer was applied onto the charge-generating layer by dip coating to form a coat, and the resultant coat was dried at 115° C. for 50 minutes to form a charge-transporting layer having a thickness of 18 μm.

(C)

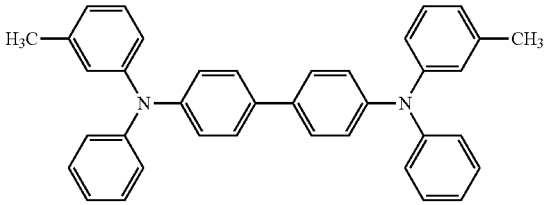

(B)

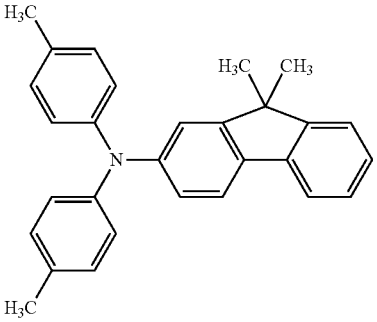

(D)

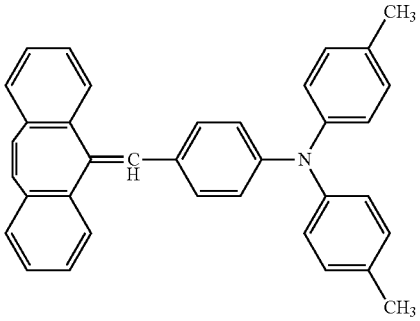

-continued (E)

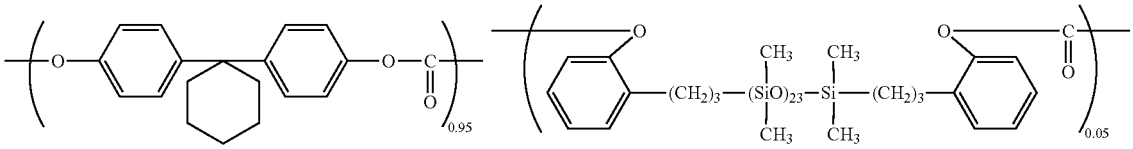

In the formula (E), 0.95 and 0.05 are molar ratios (copolymerization ratios) of the two structural units.

Formation of Protective Layer 1.65 Parts of a resin (weight-average molecular weight: 130,000) having structural units represented by the following structural formula (F) was dissolved in a mixed solvent of 40 parts of 1,1,2,2,3,3,4-heptafluorocyclopentane (product name: Zeorora H, manufactured by Zeon Corporation) and 55 parts of 1-propanol. Then, the solution having 30 parts of tetrafluoroethylene resin powder (product name: Lubron L-2, manufactured by Daikin Industries, Ltd.) added thereto was passed through a high-pressure disperser (product name: Microfluidizer M-110EH, manufactured by Microfluidics, USA) to provide a dispersion liquid. After that, 52.0 parts of a hole-transportable compound represented by the following formula (G), 2.0 parts of a compound (manufactured by Sigma-Aldrich) represented by the following formula (H), 16.0 parts of a compound (Aronix M-315, manufactured by Toagosei Co., Ltd.) represented by the following formula (I), 0.75 part of a siloxane-modified acrylic compound (BYK-3550, manufactured by BYK Japan KK), 35 parts of 1,1,2,2,3,3,4-heptafluorocyclopentane, and 15 parts of 1-propanol were added to the dispersion liquid, followed by filtration with a polyflon filter (product name: PF-040, manufactured by Advantec Toyo Kaisha, Ltd.), to prepare a coating liquid for a protective layer.

(F)

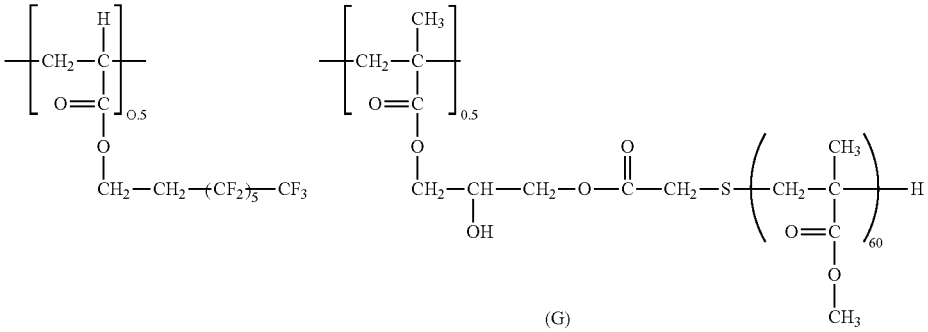

(G)

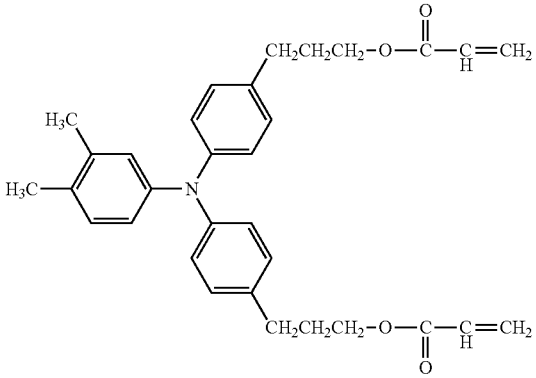

(H)

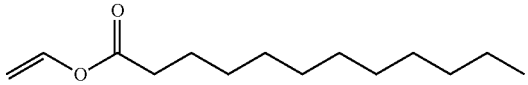

(I)

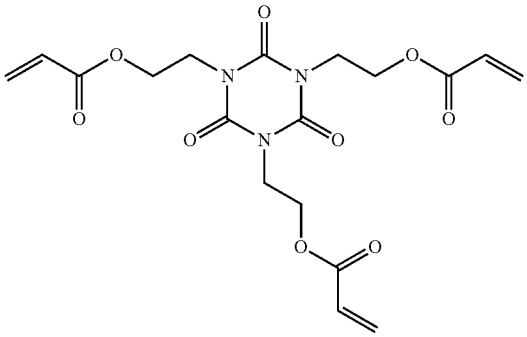

In the formula (F), 0.5 is a molar ratio (copolymerization ratio) of each of the two structural units.

The coating liquid for a protective layer was applied onto the charge-transporting layer by dip coating to form a coat, and the resultant coat was dried at 40° C. for 5 minutes. After the drying, under a nitrogen atmosphere, the coat was irradiated with electron beams under the conditions of an acceleration voltage of 70 kV and an absorbed dose of 15 kGy for 1.6 seconds. After that, under the nitrogen atmosphere, the coat was subjected to heating treatment for 15 seconds under the condition that the temperature of the coat reached 135° C. An oxygen concentration during a time period from the electron beam irradiation to the heating treatment for 15 seconds was 15 ppm. Next, in the atmosphere, the coat was naturally cooled to a temperature of 25° C., and was then subjected to heating treatment for 1 hour under the condition that the temperature of the coat reached 105° C. Thus, a protective layer (surface layer) having a thickness of 5 μm was formed.

As described above, an electrophotographic photosensitive member before formation of a surface shape, the electrophotographic photosensitive member including the protective layer, was produced.

<Surface Processing of Electrophotographic Photosensitive Member>

Formation of Recess by Mold Pressure-Contact Shape Transfer

Figure 8A:
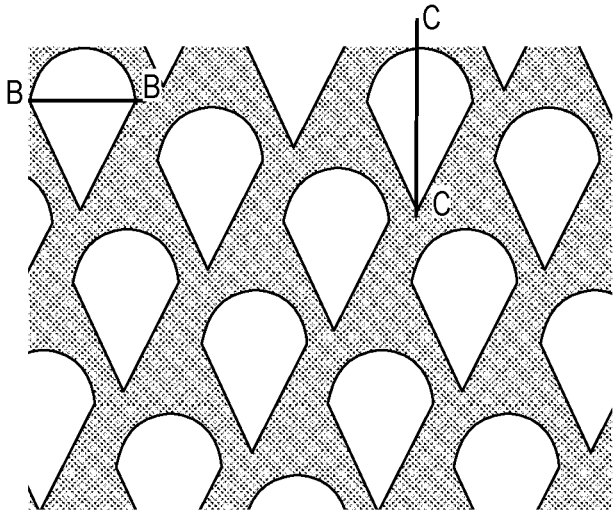
FIG. 8A is a top view for illustrating a mold used in a production example of the electrophotographic photosensitive member.
Figure 8B:
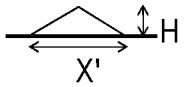
FIG. 8B is a sectional view taken along the line B-B of a protrusion in the mold illustrated in FIG. 8A.
Figure 8C:
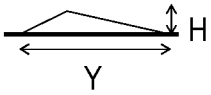
FIG. 8C is a sectional view taken along the line C-C of a protrusion in the mold illustrated in FIG. 8A.

A mold was installed in a pressure-contact shape transfer processing apparatus substantially having a configuration illustrated in FIG. 2. The mold substantially had a maximum width X' of a protrusion of the mold illustrated in FIG. 8B (maximum width in an axis direction when the protrusion on the mold illustrated in FIG. 8A is viewed from above, that is, width in a sectional view taken along the line B-B) of 30 μm, a maximum length Y of the protrusion of the mold illustrated in FIG. 8C (maximum length in a circumferential direction when the protrusion on the mold illustrated in FIG. 8A is viewed from above, that is, length in a sectional view taken along the line C-C) of 75 μm, a maximum height H of the protrusion of the mold of 1.0 μm, and an area ratio of 60%. The peripheral surface of the produced electrophotographic photosensitive member before formation of recesses was subjected to processing. During the processing, the temperatures of the electrophotographic photosensitive member and the mold were controlled so that the temperature of the peripheral surface of the electrophotographic photosensitive member reached 120° C., and the electrophotographic photosensitive member was rotated in the circumferential direction while the electrophotographic photosensitive member and the pressurizing member of the apparatus were pressed against each other with a pressure of 7.0 MPa. Thus, recesses were formed over the entire peripheral surface of the electrophotographic photosensitive member.

As described above, the electrophotographic photosensitive member having the recesses on the peripheral surface was produced.

Observation of Peripheral Surface of Electrophotographic Photosensitive Member

Magnified observation of the peripheral surface of the obtained electrophotographic photosensitive member was performed with a lens having a magnification of 50 times of a laser microscope (manufactured by Keyence Corporation, product name: X-100), and the recesses arranged on the peripheral surface of the electrophotographic photosensitive member were determined. At a time of observation, adjustment was made so that the electrophotographic photosensitive member was not tilted in its longitudinal direction and that an apex of an arc of the electrophotographic photosensitive member was focused in its circumferential direction. The observation was performed for a square region measuring 500 μm square, and images subjected to the magnified observation were connected by image connecting application to provide a magnified observation image. In addition, regarding the obtained results, image processing height data was selected by image analysis software included with the application, and filtering treatment was performed with a filter type median.

A depth of each of the recesses, a width in the axis direction of an aperture portion thereof, a length in the circumferential direction of the aperture portion, an area of the aperture portion, an angle at an apex (intersection) formed by two straight lines, and the like were determined by the above-mentioned observation. The results are described below.

Maximum width in the axial direction of the aperture portion: 30 μm

Maximum length in the circumferential direction of the aperture portion: 75 μm

Area: 150,000 $\mu m^2$

Shape depth: 0.5 μm

Angle formed by two lines directed to the apex and a straight line in the axis direction: 76°

Angle of the apex: 28°

Angle between a straight line drawn from a deepest point to the apex and the aperture portion: 0.5°

The peripheral surface of the electrophotographic photosensitive member was observed by the same method as that described above through use of another laser microscope (manufactured by Keyence Corporation, product name: X-9500), and the same results were obtained.

Example 2

An electrophotographic photosensitive member was produced in the same manner as in Example 1 except that the amounts of butyral and the blocked isocyanate to be used for preparing the coating liquid for an undercoat layer were each set to 24.5 parts in Example 1. Mass ratios $M_\alpha/M_\beta$ and $M_{Al}/M_{Ti}$ in the undercoat layer are as shown in Table 1.

Example 3

An electrophotographic photosensitive member was produced in the same manner as in Example 1 except that the amounts of butyral and the blocked isocyanate to be used for preparing the coating liquid for an undercoat layer were each set to 7.1 parts in Example 1. Mass ratios $M_\alpha/M_\beta$ and $M_{Al}/M_{Ti}$ in the undercoat layer are as shown in Table 1.

Example 4

100 Parts of aluminum oxide particles (average primary particle diameter: 18 nm, specific surface area: 65 $m^2/g$) were mixed with 500 parts of toluene under stirring, and 2.17 parts of octyltriethoxysilane (product name: KBE-3083, manufactured by Shin-Etsu Chemical Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M2. The surface treatment amount X of the aluminum oxide particles M2 and X×n are as shown in Table 1.

An electrophotographic photosensitive member was produced in the same manner as in Example 1 except that the aluminum oxide particles M1 were changed to the aluminum oxide particles M2 to prepare a coating liquid for an undercoat layer in Example 1.

Example 5

100 Parts of aluminum oxide particles (average primary particle diameter: 0.1 μm, specific surface area: 10.3 $m^2/g$) were mixed with 500 parts of toluene under stirring, and 6.84 parts of octyltriethoxysilane (product name: KBE-3083, manufactured by Shin-Etsu Chemical Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M3. The surface treatment amount X of the aluminum oxide particles M3 and X×n are as shown in Table 1.

An electrophotographic photosensitive member was produced in the same manner as in Example 1 except that the aluminum oxide particles M1 were changed to the aluminum oxide particles M3 to prepare a coating liquid for an undercoat layer in Example 1.

Example 6

100 Parts of titanium particles (product name: TTO-55, manufactured by Ishihara Sangyo Kaisha, Ltd., average primary particle diameter: 35 nm, specific surface area: 40 $m^2/g$) were mixed with 500 parts of toluene under stirring, and 2.38 parts of N-2-(aminoethyl)-3-aminopropylmethyldimethoxysilane (product name: KBM-602, manufactured by Shin-Etsu Chemical Co., Ltd.) was added to the resultant, followed by stirring for 1 hour.

After that, toluene was removed by distillation under reduced pressure, and the residue was dried by heating at 130° C. for 6 hours to provide surface-treated titanium oxide particles N2.

An electrophotographic photosensitive member was produced in the same manner as in Example 1 except that the titanium oxide particles N1 were changed to the titanium oxide particles N2 to prepare a coating liquid for an undercoat layer in Example 1.

Example 7

100 Parts of titanium particles (product name: CR-EL, manufactured by Ishihara Sangyo Kaisha, Ltd., average primary particle diameter: 0.25 μm, specific surface area: 6.8 $m^2/g$) were mixed with 500 parts of toluene under stirring, and 13.97 parts of N-2-(aminoethyl)-3-aminopropylmethyldimethoxysilane (product name: KBM-602, manufactured by Shin-Etsu Chemical Co., Ltd.) was added to the resultant, followed by stirring for 1 hour.

After that, toluene was removed by distillation under reduced pressure, and the residue was dried by heating at 130° C. for 6 hours to provide surface-treated titanium oxide particles N3.

An electrophotographic photosensitive member was produced in the same manner as in Example 1 except that the titanium oxide particles N1 were changed to the titanium oxide particles N3 to prepare a coating liquid for an undercoat layer in Example 1.

Example 8

100 Parts of zinc oxide particles (product name: MZ300, manufactured by Tayca Corporation, average primary particle diameter: 35 nm, specific surface area: 30 $m^2/g$) were mixed with 500 parts of toluene under stirring, and 3.17 parts of N-2-(aminoethyl)-3-aminopropylmethyldimethoxysilane (product name: KBM-602, manufactured by Shin-Etsu Chemical Co., Ltd.) was added to the resultant, followed by stirring for 1 hour.

After that, toluene was removed by distillation under reduced pressure, and the residue was dried by heating at 130° C. for 6 hours to provide surface-treated zinc oxide particles P1.

An electrophotographic photosensitive member was produced in the same manner as in Example 1 except that the amounts of the aluminum oxide particles M1, the titanium oxide particles N1, and the zinc oxide particles P1 to be used for preparing the coating liquid for an undercoat layer were set to 21.87 parts, 7.29 parts, and 24.84 parts, respectively in Example 1. Mass ratios $M_\alpha/M_\beta$ and $M_{Al}/M_{Ti}$ in the undercoat layer are as shown in Table 1.

Example 9

An electrophotographic photosensitive member was produced in the same manner as in Example 1 except that the amounts of the aluminum oxide particles M1 and the titanium oxide particles N1 to be used for preparing the coating liquid for an undercoat layer were set to 17.5 parts and 36.5 parts, respectively in Example 1. Mass ratios $M_\alpha/M_\beta$ and $M_{Al}/M_{Ti}$ in the undercoat layer are as shown in Table 1.

Example 10

An electrophotographic photosensitive member was produced in the same manner as in Example 1 except that the amounts of the aluminum oxide particles M1 and the titanium oxide particles N1 to be used for preparing the coating liquid for an undercoat layer were set to 49 parts and 5 parts, respectively in Example 1. Mass ratios $M_\alpha/M_\beta$ and $M_{Al}/M_{Ti}$ in the undercoat layer are as shown in Table 1.

Example 11

An electrophotographic photosensitive member was produced in the same manner as in Example 1 except that the amounts of the aluminum oxide particles M1 and the titanium oxide particles N1 to be used for preparing the coating liquid for an undercoat layer were set to 12.5 parts and 41.5 parts, respectively in Example 1. Mass ratios $M_\alpha/M_\beta$ and $M_{Al}/M_{Ti}$ in the undercoat layer are as shown in Table 1.

Example 12

An electrophotographic photosensitive member was produced in the same manner as in Example 1 except that the amounts of the aluminum oxide particles M1 and the titanium oxide particles N1 to be used for preparing the coating liquid for an undercoat layer were set to 49.9 parts and 4.1 parts, respectively in Example 1. Mass ratios $M_\alpha/M_\beta$ and $M_{Al}/M_{Ti}$ in the undercoat layer are as shown in Table 1.

Example 13

An electrophotographic photosensitive member was produced in the same manner as in Example 1 except that the amounts of the aluminum oxide particles M1 and the titanium oxide particles N1 to be used for preparing the coating liquid for an undercoat layer were set to 53.5 parts and 0.5 part, respectively in Example 1. Mass ratios $M_\alpha/M_\beta$ and $M_{Al}/M_{Ti}$ in the undercoat layer are as shown in Table 1.

Example 14

An electrophotographic photosensitive member was produced in the same manner as in Example 1 except that the amounts of the aluminum oxide particles M1 and the titanium oxide particles N1 to be used for preparing the coating liquid for an undercoat layer were set to 53.946 parts and 0.054 part, respectively in Example 1. Mass ratios $M_\alpha/M_\beta$ and $M_{Al}/M_{Ti}$ in the undercoat layer are as shown in Table 1.

Example 15

An electrophotographic photosensitive member was produced in the same manner as in Example 1 except that the titanium oxide particles N1 were changed to alumina-treated titanium particles (product name: TTO-55(A), manufactured by Ishihara Sangyo Kaisha, Ltd., average primary particle diameter: 35 nm) to prepare a coating liquid for an undercoat layer in Example 1.

Example 16

An electrophotographic photosensitive member was produced in the same manner as in Example 1 except that the titanium oxide particles N1 were changed to surface-untreated titanium oxide particles NO (average primary particle diameter: 6 nm) to prepare a coating liquid for an undercoat layer in Example 1.

Example 17

100 Parts of aluminum oxide particles (average primary particle diameter: 13 nm, specific surface area: 99 $m^2/g$) were mixed with 500 parts of toluene under stirring, and 0.96 part of N-2-(aminoethyl)-3-aminopropylmethyldimethoxysilane (product name: KBM-602, manufactured by Shin-Etsu Chemical Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M4.

An electrophotographic photosensitive member was produced in the same manner as in Example 1 except that the aluminum oxide particles M1 were changed to the aluminum oxide particles M4 to prepare a coating liquid for an undercoat layer in Example 1.

Example 18

100 Parts of aluminum oxide particles (average primary particle diameter: 13 nm, specific surface area: 99 $m^2/g$) were mixed with 500 parts of toluene under stirring, and 0.38 part of hexyltrimethoxysilane (product name: KBM-3063, manufactured by Shin-Etsu Chemical Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M5. The surface treatment amount X of the aluminum oxide particles M5 and X×n are as shown in Table 1.

An electrophotographic photosensitive member was produced in the same manner as in Example 1 except that the aluminum oxide particles M1 were changed to the aluminum oxide particles M5 to prepare a coating liquid for an undercoat layer in Example 1.

Example 19

100 Parts of aluminum oxide particles (average primary particle diameter: 13 nm, specific surface area: 99 $m^2/g$) were mixed with 500 parts of toluene under stirring, and 0.68 part of dodecyltrimethoxysilane (product name: D3383, manufactured by Tokyo Chemical Industry Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M6. The surface treatment amount X of the aluminum oxide particles M6 and X×n are as shown in Table 1.

An electrophotographic photosensitive member was produced in the same manner as in Example 1 except that the aluminum oxide particles M1 were changed to the aluminum oxide particles M6 to prepare a coating liquid for an undercoat layer in Example 1.

Example 20

100 Parts of aluminum oxide particles (average primary particle diameter: 13 nm, specific surface area: 99 $m^2/g$) were mixed with 500 parts of toluene under stirring, and 0.53 part of octadecyltrimethoxysilane (product name: O0256, manufactured by Tokyo Chemical Industry Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M7. The surface treatment amount X of the aluminum oxide particles M7 and X×n are as shown in Table 1.

An electrophotographic photosensitive member was produced in the same manner as in Example 1 except that the aluminum oxide particles M1 were changed to the aluminum oxide particles M7 to prepare a coating liquid for an undercoat layer in Example 1.

Example 21

100 Parts of aluminum oxide particles (average primary particle diameter: 18 nm, specific surface area: 65 $m^2/g$) were mixed with 500 parts of toluene under stirring, and 2.17 parts of octyltriethoxysilane (product name: KBE-3083, manufactured by Shin-Etsu Chemical Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M8. The surface treatment amount X of the aluminum oxide particles M8 and X×n are as shown in Table 1.

An electrophotographic photosensitive member was produced in the same manner as in Example 1 except that the aluminum oxide particles M1 were changed to the aluminum oxide particles M8 to prepare a coating liquid for an undercoat layer in Example 1.

Example 22

100 Parts of aluminum oxide particles (average primary particle diameter: 13 nm, specific surface area: 99 $m^2/g$)

were mixed with 500 parts of toluene under stirring, and 0.22 part of isobutyltrimethoxysilane (product name: Z-2306, manufactured by Dow Corning Toray Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M9. The surface treatment amount X of the aluminum oxide particles M9 and X×n are as shown in Table 1.

An electrophotographic photosensitive member was produced in the same manner as in Example 1 except that the aluminum oxide particles M1 were changed to the aluminum oxide particles M9 to prepare a coating liquid for an undercoat layer in Example 1.

Example 23

100 Parts of aluminum oxide particles (average primary particle diameter: 13 nm, specific surface area: 99 $m^2/g$) were mixed with 500 parts of toluene under stirring, and 0.84 part of octadecyltrimethoxysilane (product name: O0256, manufactured by Tokyo Chemical Industry Co., Ltd.) was added to the resultant, followed by stirring for 6 hours.

After that, toluene was removed by distillation under reduced pressure, and the residue was dried by heating at 140° C. for 6 hours to provide surface-treated aluminum oxide particles M10. The surface treatment amount X of the aluminum oxide particles M10 and X×n are as shown in Table 1.

An electrophotographic photosensitive member was produced in the same manner as in Example 1 except that the aluminum oxide particles M1 were changed to the aluminum oxide particles M10 to prepare a coating liquid for an undercoat layer in Example 1.

Example 24

An electrophotographic photosensitive member was produced in the same manner as in Example 1 except that the aluminum oxide particles M1 were changed to surface-untreated aluminum oxide particles M0 (average primary particle diameter: 13 nm) to prepare a coating liquid for an undercoat layer in Example 1.

Example 25

An electrophotographic photosensitive member was produced in the same manner as in Example 1 except that an undercoat layer having a thickness of 5 μm was formed in Example 1.

Example 26

An electrophotographic photosensitive member was produced in the same manner as in Example 1 except that an undercoat layer having a thickness of 10 μm was formed in Example 1.

Example 27

An electrophotographic photosensitive member was produced in the same manner as in Example 1 except that an undercoat layer having a thickness of 18 μm was formed in Example 1.

Example 28

An electrophotographic photosensitive member was produced in the same manner as in Example 1 except that an undercoat layer having a thickness of 30 μm was formed in Example 1.

Example 29

An electrophotographic photosensitive member was produced in the same manner as in Example 1 except that 30 parts of alcohol-soluble copolymerized polyamide (product name: Amilan CM8000, manufactured by Toray Industries, Inc., nylon 6/66/610/612 copolymer) serving as a binder resin was used instead of butyral and the blocked isocyanate to be used for preparing the coating liquid for an undercoat layer in Example 1.

Example 30

An electrophotographic photosensitive member was produced in the same manner as in Example 1 except that 30 parts of phenol (product name: Plyophen J-325, manufactured by DIC Corporation (former Dainippon Ink & Chemicals, Inc.)) serving as a binder resin was used instead of butyral and the blocked isocyanate to be used for preparing the coating liquid for an undercoat layer in Example 1.

Example 31

An electrophotographic photosensitive member was produced in the same manner as in Example 1 except that the coat for an undercoat layer formed on the support was dried at 150° C. for 50 minutes to form an undercoat layer having a thickness of 1.2 μm in Example 1.

Example 32

An electrophotographic photosensitive member was produced in the same manner as in Example 1 except that the coat for an undercoat layer formed on the support was dried at 170° C. for 20 minutes to form an undercoat layer having a thickness of 1.2 μm in Example 1.

Example 33

An electrophotographic photosensitive member was produced in the same manner as in Example 1 except that a support subjected to surface treatment as described below was used.

A cylindrical aluminum cylinder (JIS-A3003, aluminum alloy having a diameter of 30 mm, a length of 357.5 mm, and a thickness of 0.7 mm) having a surface subjected to cutting treatment under the following conditions was used as a support (conductive support).

The support was mounted on a lathe and cut with a diamond sintered cutting tool so that its outer diameter was 30.0±0.02 mm, its runout accuracy was 15 μm, and its surface roughness Rz was 0.2 μm. The revolution number of a main shaft in this case was 3,000 rpm, the feed speed of the cutting tool was 0.3 mm/rev, and a machining time was 24 seconds except for the attachment and detachment of the workpiece.

The surface roughness was measured under the conditions of a cutoff of 0.8 mm and a measurement length of 8 mm through use of a surface roughness meter Surfcorder SE3500 manufactured by Kosaka Laboratory Ltd. in accordance with JIS B 0601.

The obtained aluminum cut tube was subjected to liquid honing treatment under the following conditions through use of a liquid (wet) honing apparatus.

(Liquid Honing Conditions)

Abrasive grains: spherical alumina beads having an average particle diameter of 30 μm (product name: CB-A30S, manufactured by Showa Denko K.K.)

Suspending medium: water

Abrasive/suspending medium: 1/9 (volume ratio)

Aluminum cut tube rotation number: 1.67 $s^{-1}$

Air blowing pressure: 0.15 MPa

Gun moving speed: 13.3 mm/sec.

Distance between gun nozzle and aluminum tube: 200 mm

Honing grain ejection angle: 45°

Abrasive liquid projection number: once (one way)

The surface roughnesses Rmax, Rz, and Ra of the cylinder after the honing were 2.53 μm, 1.51 μm, and 0.23 μm, respectively, and the average interval Sm thereof was 34 μm. Immediately after the wet honing treatment was performed as described above, the aluminum cylinder was temporarily immersed in a dipping tank filled with pure water. Then, the aluminum cylinder was pulled up and washed with a pure water shower before the aluminum cylinder was dried. After that, warm water at 85° C. was ejected from an ejection nozzle to be brought into contact with an inner surface of a base, to thereby dry an outer surface thereof. Then, the inner surface of the base was dried by natural drying.

The aluminum cylinder subjected to surface processing as described above was used as the support of the electrophotographic photosensitive member.

Example 34

An electrophotographic photosensitive member was produced in the same manner as in Example 1 except that a conductive layer was arranged on the support as described below.

57 Parts of titanium oxide particles each having a coating layer (product name: Passtran LRS, manufactured by Mitsui Mining & Smelting Co., Ltd.), 35 parts of a resol-type phenolic resin (product name: PHENOLITE J-325, manufactured by DIC Corporation (former Dainippon Ink & Chemicals, Inc.), methanol solution with a solid content of 60%), and 33 parts of 2-methoxy-1-propanol were dispersed with a sand mill using glass beads each having a diameter of 1 mm for 3 hours to prepare a dispersion liquid. The average particle diameter of powder contained in the dispersion liquid was 0.30 μm. A solution obtained by dispersing 8 parts of a silicone resin (product name: Tospearl 120, manufactured by Momentive Performance Materials Japan LLC (former Toshiba Silicone Co., Ltd.)) in 8 parts of 2-methoxy-1-propanol was added to the dispersion liquid. Further, 0.008 part of a silicone oil (product name: SH28PA, manufactured by Dow Corning Toray Co., Ltd. (former Toray Dow Corning Silicone Co., Ltd.)) was added to the resultant. The dispersion liquid thus prepared was applied onto the aluminum cylinder by a dipping method. The dispersion liquid was cured by heating for 30 minutes in a hot air dryer adjusted to 150° C. so that a coated film of the dispersion liquid was cured. Thus, a conductive layer having a thickness of 30 μm was formed.

Example 35

An electrophotographic photosensitive member was produced in the same manner as in Example 1 except that a charge-transporting layer was formed as described below without the formation of the protective layer.

72 Parts of the compound represented by the structural formula (B), 8 parts of the compound represented by the structural formula (D), 100 parts of a compound represented by the following structural formula (J), and 1.8 parts of a compound represented by the following structural formula (K) were dissolved in a mixed solvent of 360 parts of o-xylene, 160 parts of methyl benzoate, and 270 parts of dimethoxymethane (methylal) to prepare a coating liquid for a charge-transporting layer.

The coating liquid for a charge-transporting layer was applied onto the charge-generating layer by dip coating to form a coat, and the resultant coat was dried at 125° C. for 50 minutes to form a charge-transporting layer having a thickness of 20 μm.

(J)

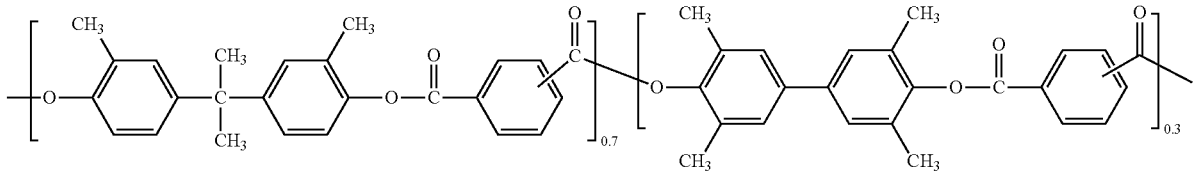

(K)

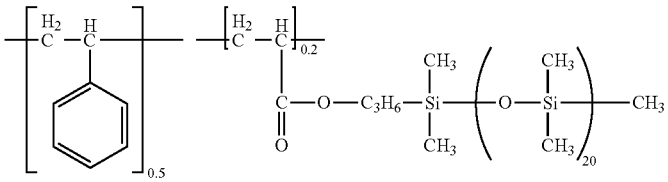

In the formula (J), 0.7 and 0.3 represent copolymerization ratios of two structural units. In addition, in the formula (K), 0.8 and 0.2 represent copolymerization ratios of two structural units.

Comparative Example 1

An electrophotographic photosensitive member was produced in the same manner as in Example 1 except that the amounts of butyral and the blocked isocyanate to be used for preparing the coating liquid for an undercoat layer were each set to 29.5 parts in Example 1.

Comparative Example 2

An electrophotographic photosensitive member was produced in the same manner as in Example 1 except that the amounts of butyral and the blocked isocyanate to be used for preparing the coating liquid for an undercoat layer were each set to 6.5 parts in Example 1.

Comparative Example 3

An electrophotographic photosensitive member was produced in the same manner as in Example 1 except that the amounts of the aluminum oxide particles M1, the titanium oxide particles N1, and the zinc oxide particles P1 to be used for preparing the coating liquid for an undercoat layer were set to 19.44 parts, 6.48 parts, and 28.08 parts, respectively in Example 1.

Comparative Example 4

An electrophotographic photosensitive member was produced in the same manner as in Example 1 except that the amounts of the aluminum oxide particles M1 and the titanium oxide particles N1 to be used for preparing the coating liquid for an undercoat layer were set to 9 parts and 45 parts, respectively in Example 1. Mass ratios $M_\alpha/M_\beta$ and $M_{Al}/M_{Ti}$ in the undercoat layer are as shown in Table 1.

Comparative Example 5

An electrophotographic photosensitive member was produced in the same manner as in Example 1 except that the amounts of the aluminum oxide particles M1 and the titanium oxide particles N1 to be used for preparing the coating liquid for an undercoat layer were set to 53.95 parts and 0.05 part, respectively in Example 1. Mass ratios $M_\alpha/M_\beta$ and $M_{Al}/M_{Ti}$ in the undercoat layer are as shown in Table 1.

TABLE 1

| | Undercoat layer formulation | | | | | |
|---|---|---|---|---|---|---|
| | Aluminum oxide particles | | | Name of | | |
| Example No. | Name | Surface treatment amount X [Mass %] | n × X | titanium oxide particles | $M_{Al}/M_{Ti}$ | $M_\alpha/M_\beta$ |
| Example 1 | M1 | 8.78 | 70.2 | N1 | 3 | 1.8 |
| Example 2 | M1 | 8.78 | 70.2 | N1 | 3 | 1.1 |
| Example 3 | M1 | 8.78 | 70.2 | N1 | 3 | 3.8 |
| Example 4 | M2 | 11.52 | 92.2 | N1 | 3 | 1.8 |
| Example 5 | M3 | 0.91 | 7.3 | N1 | 3 | 1.8 |
| Example 6 | M1 | 8.78 | 70.2 | N2 | 3 | 1.8 |
| Example 7 | M1 | 8.78 | 70.2 | N3 | 3 | 1.8 |
| Example 8 | M1 | 8.78 | 70.2 | N1 | 3 | 1.8 |
| Example 9 | M1 | 8.78 | 70.2 | N1 | 0.48 | 1.8 |
| Example 10 | M1 | 8.78 | 70.2 | N1 | 10 | 1.8 |
| Example 11 | M1 | 8.78 | 70.2 | N1 | 0.30 | 1.8 |
| Example 12 | M1 | 8.78 | 70.2 | N1 | 12 | 1.8 |
| Example 13 | M1 | 8.78 | 70.2 | N1 | 107 | 1.8 |
| Example 14 | M1 | 8.78 | 70.2 | N1 | 999 | 1.8 |
| Example 15 | M1 | 8.78 | 70.2 | TTO-55(A) | 3 | 1.8 |
| Example 16 | M1 | 8.78 | 70.2 | N0 | 3 | 1.8 |
| Example 17 | M4 | — | — | N1 | 3 | 1.8 |
| Example 18 | M5 | 2.62 | 15.7 | N1 | 3 | 1.8 |
| Example 19 | M6 | 9.2 | 110.4 | N1 | 3 | 1.8 |
| Example 20 | M7 | 11.84 | 213.2 | N1 | 3 | 1.8 |
| Example 21 | M8 | 29.26 | 234 | N1 | 3 | 1.8 |
| Example 22 | M9 | 1.13 | 4.5 | N1 | 3 | 1.8 |
| Example 23 | M10 | 18.95 | 341.1 | N1 | 3 | 1.8 |
| Example 24 | M0 | — | — | N1 | 3 | 1.8 |
| Example 25 | M1 | 8.78 | 70.2 | N1 | 3 | 1.8 |
| Example 26 | M1 | 8.78 | 70.2 | N1 | 3 | 1.8 |
| Example 27 | M1 | 8.78 | 70.2 | N1 | 3 | 1.8 |
| Example 28 | M1 | 8.78 | 70.2 | N1 | 3 | 1.8 |
| Example 29 | M1 | 8.78 | 70.2 | N1 | 3 | 1.8 |
| Example 30 | M1 | 8.78 | 70.2 | N1 | 3 | 1.8 |
| Example 31 | M1 | 8.78 | 70.2 | N1 | 3 | 1.8 |
| Example 32 | M1 | 8.78 | 70.2 | N1 | 3 | 1.8 |
| Example 33 | M1 | 8.78 | 70.2 | N1 | 3 | 1.8 |
| Example 34 | M1 | 8.78 | 70.2 | N1 | 3 | 1.8 |
| Example 35 | M1 | 8.78 | 70.2 | N1 | 3 | 1.8 |
| Comparative Example 1 | M1 | 8.78 | 70.2 | N1 | 3 | 0.9 |
| Comparative Example 2 | M1 | 8.78 | 70.2 | N1 | 3 | 4.2 |
| Comparative Example 3 | M1 | 8.78 | 70.2 | N1 | 3 | 1.8 |
| Comparative Example 4 | M1 | 8.78 | 70.2 | N1 | 0.20 | 1.8 |
| Comparative Example 5 | M1 | 8.78 | 70.2 | N1 | 1,079 | 1.8 |

<Evaluation of Electrophotographic Photosensitive Member>

Each of the produced electrophotographic photosensitive members was mounted on evaluation apparatus 1 and 2 described below, and the following evaluation was carried out.

[Evaluation Apparatus 1]

Each of the electrophotographic photosensitive members produced in Examples 1 to 35 and Comparative Examples 1 to 5 was mounted on a remodeled apparatus (a charging unit had a system of applying a DC voltage to a roller-type contact charging member (charging roller), and an exposing unit had a laser image exposure system (wavelength: 780 nm)) of a copying machine imageRUNNER (iR) (trademark)-ADV C5051 manufactured by Canon Inc., and evaluation was carried out.

Specifically, regarding image output in cracking evaluation, the above-mentioned evaluation apparatus was installed under a normal-temperature and normal-humidity (23° C./50% RH) environment, and regarding image output in ghost evaluation, the above-mentioned evaluation apparatus was installed under a low-temperature and low-humidity (15° C./10% RH) environment. The produced electrophotographic photosensitive member was mounted on a process cartridge for cyan color and then mounted on a station of the process cartridge for cyan color, and evaluation was carried out.

As a charging condition, a DC component (initial dark portion potential (Vd)) applied to the charging roller was set to −700 V in the cracking evaluation and −750 V in the ghost evaluation. In addition, an exposure condition was adjusted so that an initial light portion potential (Vl) before repeated use when laser exposure light was radiated was −200 V in the cracking evaluation and −150 V in the ghost evaluation.

The surface potential of the electrophotographic photosensitive member was measured by removing a developing cartridge from the above-mentioned evaluation apparatus and inserting a potential measurement apparatus into the remainder. The potential measurement apparatus has a configuration in which a potential measurement probe (product name: model 6000B-8, manufactured by Trek Japan KK) is arranged at a development position of the developing cartridge. The position of the potential measurement probe with respect to the electrophotographic photosensitive member was set to the center in a generatrix direction of the electrophotographic photosensitive member, and its gap from the surface of the electrophotographic photosensitive member was set to 3 mm. Further, the potential at the center of the electrophotographic photosensitive member was measured through use of a surface potential gauge (product name: model 344, manufactured by Trek Japan KK).

[Evaluation Apparatus 2]

The electrophotographic photosensitive member produced in Example 1 was mounted on a remodeled apparatus (a charging unit had a system of applying a voltage in which an AC voltage was superimposed on a DC voltage to the electrophotographic photosensitive member by bringing a roller-type contact charging member (charging roller) into abutment against the electrophotographic photosensitive member, and an exposing unit had a laser image exposure system (wavelength: 780 nm)) of a copying machine iR-ADV C5051 manufactured by Canon Inc., and evaluation was carried out.

Specifically, regarding image output in cracking evaluation, the above-mentioned evaluation apparatus was installed under a normal-temperature and normal-humidity (23° C./50% RH) environment, and regarding image output in ghost evaluation, the above-mentioned evaluation apparatus was installed under a low-temperature and low-humidity (15° C./10% RH) environment. The produced electrophotographic photosensitive member was mounted on a process cartridge for cyan color and then mounted on a station of the process cartridge for cyan color, and evaluation was carried out.

As a charging condition in the cracking evaluation, the peak-to-peak voltage and frequency of an AC component to be applied to the charging roller were set to 1,300 V and 1,300 Hz, respectively, and a DC component (initial dark portion potential (Vd)) was set to −700 V. As a charging condition in the ghost evaluation, the peak-to-peak voltage and frequency of an AC component to be applied to the charging roller were set to 1,350 V and 1,300 Hz, respectively, and a DC component (initial dark portion potential (Vd)) was set to −750 V. In addition, an exposure condition was adjusted so that an initial light portion potential (Vl) before repeated use when laser exposure light was radiated was −200 V in the cracking evaluation and −150 V in the ghost evaluation.

The surface potential of the electrophotographic photosensitive member was measured by removing a developing cartridge from the above-mentioned evaluation apparatus and inserting a potential measurement apparatus into the remainder. The potential measurement apparatus has a configuration in which a potential measurement probe (product name: model 6000B-8, manufactured by Trek Japan KK) is arranged at a development position of the developing cartridge. The position of the potential measurement probe with respect to the electrophotographic photosensitive member was set to the center in a generatrix direction of the electrophotographic photosensitive member, and its gap from the surface of the electrophotographic photosensitive member was set to 3 mm. Further, the potential at the center of the electrophotographic photosensitive member was measured through use of a surface potential gauge (product name: model 344, manufactured by Trek Japan KK).

Cracking Evaluation

Cracking was evaluated by microscope observation of the surface of a coat and observation of an image output by mounting an electrophotographic photosensitive member on an evaluation apparatus. The microscope observation of the surface of the coat was performed as described below. Only the undercoat layer was formed on the support by the method described in each of Examples 1 to 35 and Comparative Examples 1 to 5, and the undercoat layer was allowed to stand for 7 days, 14 days, and 28 days, respectively under a high-temperature and high-humidity (30° C./80% RH) environment. After that, the evaluation was performed by observing the surface of the coat with an optical electron microscope.

Figure 9:
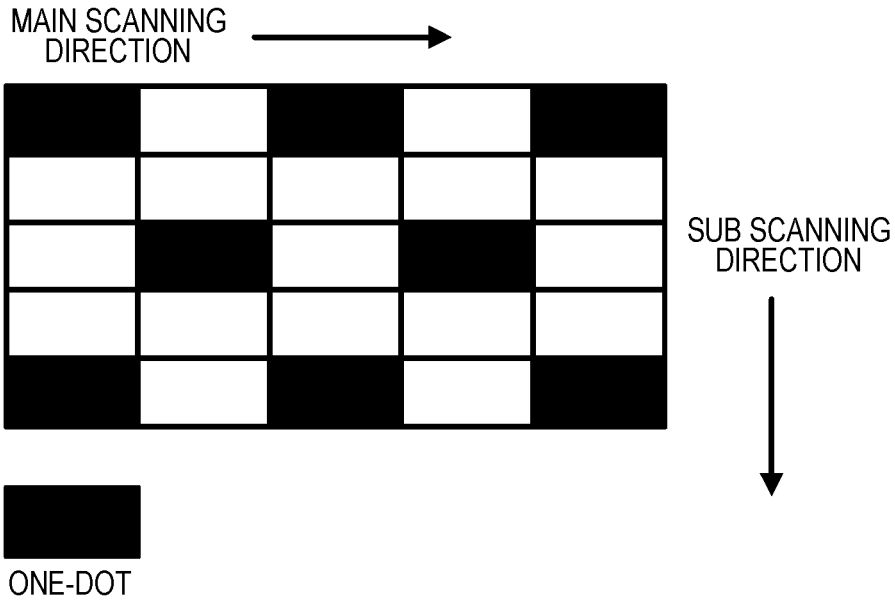
FIG. 9 is a view for illustrating a one-dot knight jump pattern image.

The observation of the image was performed as described below. The electrophotographic photosensitive member produced by the method described in each of Examples 1 to 35 and Comparative Examples 1 to 5 was allowed to stand for 7 days, 14 days, and 28 days, respectively under a high-temperature and high-humidity (30° C./80% RH) environment. After that, the electrophotographic photosensitive member was allowed to stand for 1 day under a normal-temperature and normal-humidity (23° C./50% RH) environment. A developing cartridge having mounted thereon the electrophotographic photosensitive member after being allowed to stand was mounted on each of the evaluation apparatus 1 and 2, and a solid black image, a solid white image, and a cyan monochromatic halftone image of a one-dot knight jump pattern were each output through use of A4-size plain paper. Cracking was evaluated by observing the output images. The halftone image of a one-dot knight jump pattern corresponds to a halftone image of a pattern illustrated in FIG. 9.

Based on the electron microscope observation of the surface of the coat and the observation of the image performed by the above-mentioned methods, evaluation was carried out in accordance with the following cracking evaluation rank. In the present disclosure, ranks A and B are levels at which the effects of the present disclosure are obtained. Of those, the rank A was determined to be an excellent level. Meanwhile, a rank C was determined to be a level at which the effects of the present disclosure were not obtained.

A: When the surface of the undercoat layer is observed with an optical microscope, the occurrence of cracking cannot be confirmed.

B: When the surface of the undercoat layer is observed with an optical microscope, the occurrence of cracking can be confirmed, but image defects caused by the cracking are not observed on any of the solid black image, the solid white image, and the halftone image of a one-dot knight jump pattern.

C: When the surface of the undercoat layer is observed with an optical microscope, the occurrence of cracking can be confirmed, and image defects considered to be caused by the cracking are observed on any one of the solid black image, the solid white image, and the halftone image of a one-dot knight jump pattern.

The results obtained by carrying out evaluation through use of the evaluation apparatus 1 as described above are shown in Table 2, and the results obtained by carrying out evaluation through use of the evaluation apparatus 2 as described above are shown in Table 3.

Ghost Evaluation

In addition, ghost evaluation was performed by the following method. The electrophotographic photosensitive member produced by the method described in each of Examples 1 to 35 and Comparative Examples 1 to 5 was allowed to stand for 3 days under a low-temperature and low-humidity (15° C./10% RH) environment together with the evaluation apparatus 1 and 2. A developing cartridge having mounted thereon the electrophotographic photosensitive member after being allowed to stand was mounted on each of the evaluation apparatus 1 and 2. Potentials were regulated to the above-mentioned initial dark portion potential Vd and initial light portion potential Vl, and after that, (initial) image output for ghost evaluation before the passage of sheets was performed under the same environment. After that, the passage of 2,000 sheets was performed under the condition that lines each having a width of 0.5 mm were printed every 10 mm in a longitudinal direction in an intermittent mode in which four sheets were able to be printed per minute. After the passage of sheets, image output for ghost evaluation was performed immediately after the passage of sheets under the condition of the above-mentioned laser exposure amount and 15 hours after the passage of 2,000 sheets.

Figure 10:
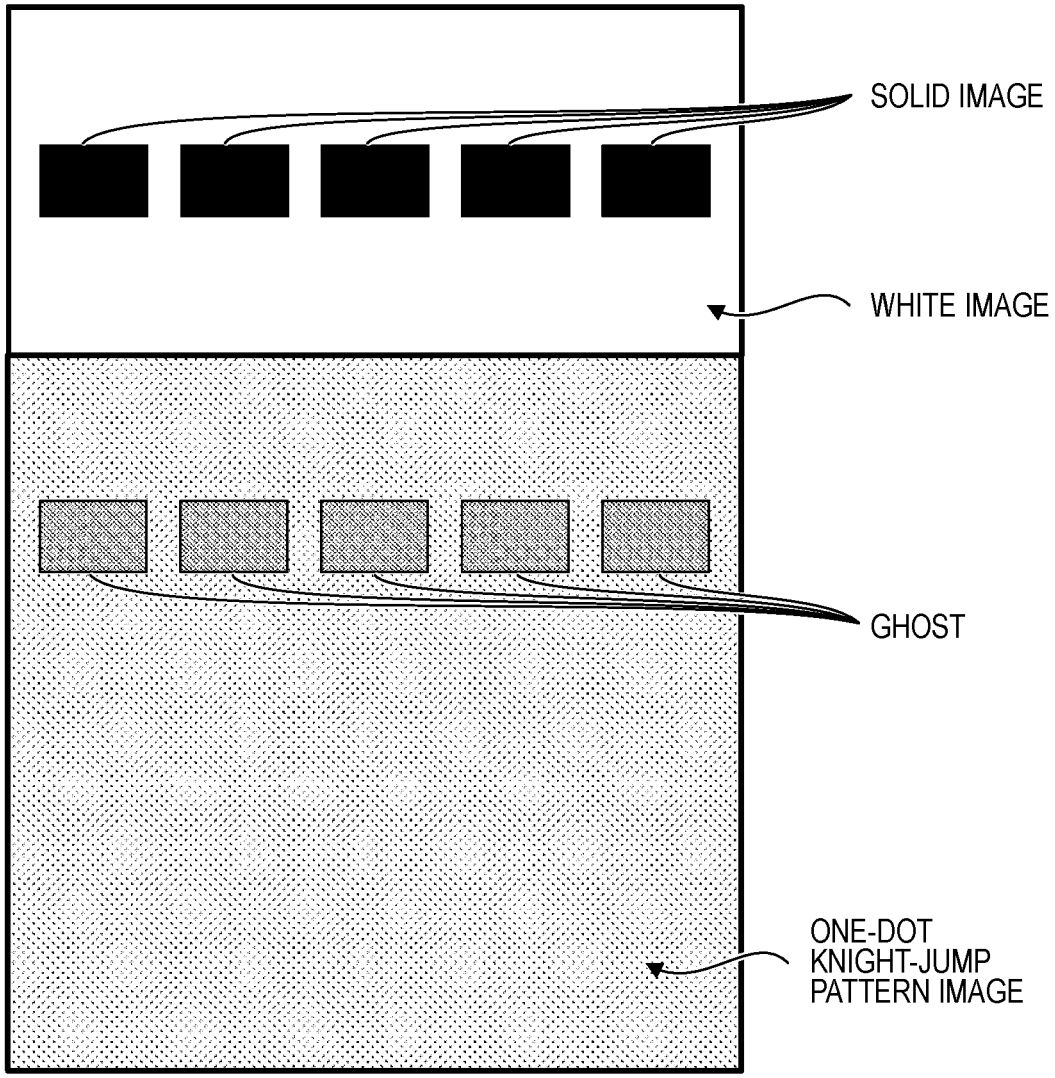
FIG. 10 is a view for illustrating an image for ghost evaluation.

An image for ghost evaluation was produced as described below. First, as illustrated in FIG. 10, square "solid images" were output in a "white image" in a leading head of the image, and after that, a "halftone image of a one-dot knight jump pattern" illustrated in FIG. 9 was produced. "Ghost" portions in FIG. 10 correspond to portions in which ghosts caused by the "solid images" may appear.

The sampling of the ghost image evaluation was carried out in an F5 (density center value) mode and an F9 (thin density) mode (in which a ghost was more visible) of a development volume in each of the evaluation apparatus 1 and 2. The evaluation was visually performed, and the degree of a ghost was evaluated in accordance with the following criteria. In the present disclosure, ranks A and B are levels at which the effects of the present disclosure are obtained. Of those, the rank A was determined to be an excellent level. Meanwhile, ranks C, D, and E were determined to be levels at which the effects of the present disclosure were not obtained.

A: A ghost cannot be seen in any mode.

B: A ghost can be seen slightly in one of the modes.

C: A ghost can be seen slightly in any mode.

D: A ghost can be seen in any mode.

E: A ghost can be seen clearly in any mode.

The results obtained by carrying out evaluation through use of the evaluation apparatus 1 as described above are shown in Table 2, and the results obtained by carrying out evaluation through use of the evaluation apparatus 2 as described above are shown in Table 3.

TABLE 2

| | Evaluation using evaluation apparatus 1 | | | | | |
|---|---|---|---|---|---|---|
| | Cracking evaluation | | | Ghost evaluation | | |
| | After being allowed to stand for 7 days | After being allowed to stand for 14 days | After being allowed to stand for 28 days | Initial stage | Immediately after passage of 2,000 sheets | 15 hours after passage of 2,000 sheets |
| Example 1 | A | A | A | A | A | A |
| Example 2 | A | A | A | A | A | A |
| Example 3 | A | A | A | A | A | A |
| Example 4 | A | A | A | A | A | A |
| Example 5 | A | A | A | A | A | A |
| Example 6 | A | A | A | A | A | A |
| Example 7 | A | A | A | A | A | A |
| Example 8 | A | A | A | A | A | A |
| Example 9 | A | A | B | A | A | A |
| Example 10 | A | A | A | A | A | A |
| Example 11 | A | B | B | A | A | A |
| Example 12 | A | A | A | A | A | B |
| Example 13 | A | A | A | A | B | B |
| Example 14 | A | A | A | B | B | B |
| Example 15 | A | A | B | A | A | A |
| Example 16 | A | B | B | A | A | A |
| Example 17 | A | A | B | A | A | A |

TABLE 2-continued

| | Evaluation using evaluation apparatus 1 | | | | | |
|---|---|---|---|---|---|---|
| | Cracking evaluation | | | Ghost evaluation | | |
| | After being allowed to stand for 7 days | After being allowed to stand for 14 days | After being allowed to stand for 28 days | Initial stage | Immediately after passage of 2,000 sheets | 15 hours after passage of 2,000 sheets |
| Example 18 | A | A | A | A | A | A |
| Example 19 | A | A | A | A | A | A |
| Example 20 | A | A | A | A | A | A |
| Example 21 | A | A | A | A | A | A |
| Example 22 | A | A | A | A | A | B |
| Example 23 | A | B | B | A | A | A |
| Example 24 | A | A | B | A | A | A |
| Example 25 | A | A | A | A | A | A |
| Example 26 | A | B | B | A | A | A |
| Example 27 | B | B | B | A | A | A |
| Example 28 | B | B | B | A | A | A |
| Example 29 | A | B | B | A | A | B |
| Example 30 | A | B | B | A | A | B |
| Example 31 | A | A | A | A | A | B |
| Example 32 | A | A | B | A | A | A |
| Example 33 | A | A | B | A | A | A |
| Example 34 | A | A | A | A | A | A |
| Example 35 | A | A | A | A | A | A |
| Comparative Example 1 | A | A | A | B | D | D |
| Comparative Example 2 | B | C | C | B | D | D |
| Comparative Example 3 | C | C | C | B | B | B |
| Comparative Example 4 | C | C | C | A | A | B |
| Comparative Example 5 | A | A | A | D | E | E |

TABLE 3

| | Evaluation using evaluation apparatus 2 | | | | | |
|---|---|---|---|---|---|---|
| | Cracking evaluation | | | Ghost evaluation | | |
| | After being allowed to stand for 7 days | After being allowed to stand for 14 days | After being allowed to stand for 28 days | Initial stage | Immediately after passage of 2,000 sheets | 15 hours after passage of 2,000 sheets |
| Example 1 | A | A | B | A | A | B |

As shown in Table 2, it is understood that, with the electrophotographic photosensitive member, the process cartridge, and the electrophotographic apparatus according to at least one embodiment of the present disclosure, satisfactory results can be obtained in any of the suppression of occurrence of cracking and the suppression of generation of a positive ghost image. As in the comparative examples, when the mass ratio $M_{Al}/M_{Ti}$ is smaller than 0.25, cracking occurs, and when the mass ratio $M_{Al}/M_{Ti}$ is larger than 1,000, a positive ghost is generated. Therefore, it is understood that the objects of the present disclosure cannot be achieved in the above-mentioned cases.

Further, as shown in Table 3, it is understood that the effects of the present disclosure can be sufficiently obtained in the charging unit having a system of applying only a DC voltage to the charging member as in the evaluation apparatus 1 as compared to the charging unit having a system of applying a voltage in which an AC voltage is superimposed on a DC voltage to the charging member as in the evaluation apparatus 2.

As described above, according to at least one embodiment of the present disclosure, the electrophotographic photosensitive member excellent in the suppression of generation of a positive ghost image under a low-temperature and low-humidity environment and the suppression of occurrence of cracking under a high-temperature and high-humidity environment can be provided. In addition, according to at least one embodiment of the present disclosure, the process cartridge and the electrophotographic apparatus each including the electrophotographic photosensitive member can be provided.

The present disclosure is not limited to the above-mentioned embodiments, and can be variously changed and modified without departing from the spirit and scope of the present disclosure. Thus, in order to make the scope of the present disclosure public, the following claims are attached herewith.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An electrophotographic photosensitive member comprising, in this order:

(i) a support;

(ii) an undercoat layer comprising metal oxide particles (α) and a binder resin (β); and (iii) a photosensitiver layer;

the metal oxide particles (α) comprising aluminum oxide particles and titanium oxide particles, the aluminum oxide particles being surface-treated with a silane coupling agent and the titanium oxide particles being surface-treated with a silane coupling agent, wherein $1.0 \leq M_\alpha/M_\beta \leq 4.0$ where $M_\alpha$ is a content of the metal oxide particles (α) and $M_\beta$ is a content of the binder resin (β) in the undercoat layer, a total of a content of the aluminum oxide particles and a content of the titanium oxide particles in the undercoat layer is 50 mass % or more with respect to the metal oxide particles (α) in the undercoat layer, and $0.25 \leq M_{Al}/M_{Ti} \leq 1{,}000$ where $M_{Al}$ is a content of the aluminum oxide particles and $M_{Ti}$ is a content of the titanium oxide particles in the undercoat layer.

2. The electrophotographic photosensitive member according to claim 1, wherein $0.5 \leq M_{Al}/M_{Ti} \leq 10$.

3. The electrophotographic photosensitive member according to claim 2, wherein the aluminum oxide particles are surface-treated with a compound represented by formula (1)

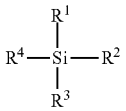

(1)

where $R^1$ to $R^3$ independently represent an alkoxy group or an alkyl group, provided that at least two of $R^1$ to $R^3$ are alkoxy groups, $R^4$ represents an alkyl group having n carbon atoms, and n is an integer of 6 to 18, and (X×n) is 10 to 330 where X is $M'_{Si}/M'_{Al} \times 100$, $M'_{Al}$ is a mass of aluminum atoms in the surface-treated aluminum oxide particles, and $M'_{Si}$ is a mass of silicon atoms derived from the compound represented by formula (1).

4. The electrophotographic photosensitive member according to claim 2, wherein the undercoat layer has a thickness of 0.1 to 10 μm, and the binder resin is a urethane resin.

5. The electrophotographic photosensitive member according to claim 3, wherein the undercoat layer has a thickness of 0.1 to 10 μm, and the binder resin is a urethane resin.

6. The electrophotographic photosensitive member according to claim 1, wherein the aluminum oxide particles are surface-treated with a compound represented by formula (1)

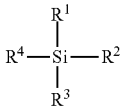

(1)

where $R^1$ to $R^3$ independently represent an alkoxy group or an alkyl group, provided that at least two of $R^1$ to $R^3$ are alkoxy groups, $R^4$ represents an alkyl group having n carbon atoms, and n is an integer of 6 to 18, and (X×n) is 10 to 330 where X is $M'_{Si}/M'_{Al} \times 100$, $M'_{Al}$ is a mass of aluminum atoms in the surface-treated aluminum oxide particles, and $M'_{Si}$ is a mass of silicon atoms derived from the compound represented by formula (1).

7. The electrophotographic photosensitive member according to claim 6, wherein the undercoat layer has a thickness of 0.1 to 10 μm, and the binder resin is a urethane resin.

8. The electrophotographic photosensitive member according to claim 6, wherein X×n is 10 to 220.

9. The electrophotographic photosensitive member according to claim 8, wherein n is 6 to 12.

10. The electrophotographic photosensitive member according to claim 9, wherein the undercoat layer has a thickness of 0.1 to 10 μm, and the binder resin is a urethane resin.

11. The electrophotographic photosensitive member according to claim 8, wherein n is 8.

12. The electrophotographic photosensitive member according to claim 8, wherein the undercoat layer has a thickness of 0.1 to 10 μm, and the binder resin is a urethane resin.

13. The electrophotographic photosensitive member according to claim 6, wherein n is 6 to 12.

14. The eleetrophotographic photosensitive member according to claim 6, wherein n is 8.

15. The electrophotographic photosensitive member according to claim 1, wherein the undercoat layer has a thickness of 0.1 to 10 μm.

16. The electrophotographic photosensitive member according to claim 1, wherein the binder resin is a urethane resin.

17. The electrophotographic photosensitive member according to claim 1, wherein the titanium oxide particles are surface-treated with N-2-(aminoethyl)-3-aminopropylmethyldimethoxysilane.

18. A process cartridge, comprising:

an electrophotographic photosensitive member;

the process cartridge integrally supporting the electrophotographic photosensitive member and at least one unit selected from the group consisting of a charging unit, a developing unit, and a cleaning unit; and the process cartridge being removably mounted on a main body of an electrophotographic apparatus, wherein the electrophotographic photosensitive member includes (i) a support, (ii) an undercoat layer comprising metal oxide particles (α) and a binder resin (β), and (iii) a photosensitive member in this order, the metal oxide particles (α) comprise aluminum oxide particles and titanium oxide particles, the aluminum oxide particles being surface-treated with a silane coupling agent and the titanium oxide particles being surface-treated with a silane coupling agent, $1.0 \leq M_\alpha/M_\beta 4.0$ where $M_\alpha$ is a content of the metal oxide particles (α) and $M_\beta$ is a content of the binder resin (β) in the undercoat layer, a total of a content of the aluminum oxide particles and a content of the titanium oxide particles in the undercoat layer is 50 mass % or more with respect to the metal oxide particles (a) in the undercoat layer, and $0.25 \leq M_{Al}/M_{Ti} \leq 1{,}000$ where $M_{Al}$ is a content of the aluminum oxide particles and $M_{Ti}$ is a content of the titanium oxide particles in the undercoat layer.

19. An electrophotographic apparatus, comprising:

an electrophotographic photosensitive member; and at least one unit selected from the group consisting of a charging unit, an exposing unit, a developing unit, and a transferring unit, wherein the electrophotographic photosensitive member includes (i) a support, (ii) an undercoat layer comprising metal oxide particles (α) and a binder resin (β), and (iii) photosensitive member in this order, the metal oxide particles (α) comprise aluminum oxide particles and titanium oxide particles, the aluminum oxide particles being surface-treated with a silane coupling agent and the titanium oxide particles being surface-treated with a silane coupling agent, $1.0 \leq M_\alpha/M_\beta \leq 4.0$ where $M_\alpha$ is a content of the metal oxide particles (α) and $M_\beta$ is a content of the binder resin (β) in the undercoat layer, a total of a content of the aluminum oxide particles and a content of the titanium oxide particles in the undercoat layer is 50 mass % or more with respect to the metal oxide particles (α) in the undercoat layer, and $0.25 \leq M_{Al}/M_{Ti} \leq 1{,}000$ where $M_{Al}$ is a content of the aluminum oxide particles and $M_{Ti}$ is a content of the titanium oxide particles in the undercoat layer.

20. The electrophotographic apparatus according to claim 19, wherein the charging unit is a charging roller which is arranged so as to be brought into abutment against the electrophotographic photosensitive member, and which is configured to charge the electrophotographic photosensitive member by applying only a DC voltage thereto.

* * * * *